US012565779B2

(12) United States Patent
Pozgay et al.

(10) Patent No.: US 12,565,779 B2
(45) Date of Patent: Mar. 3, 2026

(54) WORK PLATFORM AND METHOD

(71) Applicant: Werner Co., Itasca, IL (US)

(72) Inventors: David Pozgay, Wilmette, IL (US); Milbert O. La Valle, Taguig City (PH); Lucindo Sofronio DL. Valenciano, Barangay Kasilawan Makati City (PH); Devin Hughes, Itasca, IL (US); Slavisa Dacic, Hanover Park, IL (US); John Maher, Crystal Lake, IL (US); Weston Van Wembeke, Severna Park, MD (US)

(73) Assignee: Werner Co., Itasca, IL (US)

( * ) Notice: Subject to any disclaimer, the term of this patent is extended or adjusted under 35 U.S.C. 154(b) by 584 days.

(21) Appl. No.: 17/972,584

(22) Filed: Oct. 24, 2022

(65) Prior Publication Data

US 2023/0139449 A1 May 4, 2023

Related U.S. Application Data

(63) Continuation-in-part of application No. 17/863,220, filed on Jul. 12, 2022.
(Continued)

(51) Int. Cl.
*E04G 1/30* (2006.01)
*E04G 5/08* (2006.01)
(Continued)

(52) U.S. Cl.
CPC ..... *E04G 1/30* (2013.01); *E04G 5/08* (2013.01); *E04G 7/28* (2013.01);
(Continued)

(58) Field of Classification Search
CPC ..... E04G 1/28; E04G 1/30; E04G 2001/302; E04G 2001/305; E04G 2001/307;
(Continued)

(56) References Cited

U.S. PATENT DOCUMENTS 111,660 A * 2/1871 Martz ..... E06C 1/39 182/119
581,727 A 5/1897 Inglish
(Continued)

FOREIGN PATENT DOCUMENTS

CN 1046773 11/1990
CN 2908669 6/2007
(Continued)

OTHER PUBLICATIONS

Gorilla Ladder Model #GLP-WP, Brochure, May 2016.
(Continued)

*Primary Examiner* — Colleen M Chavchavadze
(74) *Attorney, Agent, or Firm* — Fitch, Even, Tabin & Flannery LLP

(57) ABSTRACT

A work platform includes a plank which telescopes to a desired width. The work platform includes a first leg assembly rotatably attached adjacent to a first end of the plank. The work platform includes a second leg assembly rotatably attached adjacent to a second end of the plank. The work platform includes a first linkage attached to a first leg of the first leg assembly. The first linkage may be a first hook or a first strap assembly for securing the work platform to a first support structure. A method for using a work platform. A method for producing a work platform.

9 Claims, 24 Drawing Sheets

Related U.S. Application Data

(60) Provisional application No. 63/273,127, filed on Oct. 28, 2021.

(51) Int. Cl.
*E04G 7/28* (2006.01)
*E04G 1/34* (2006.01)

(52) U.S. Cl.
CPC .. *E04G 2001/305* (2013.01); *E04G 2001/307* (2013.01); *E04G 1/34* (2013.01)

(58) Field of Classification Search
CPC .... E04G 5/08; E04G 7/04; E04G 7/28; E04G 2007/005; E04G 1/15; E04G 1/151; E04G 1/152; E04G 1/153; E04G 1/154; E06C 1/39; E06C 7/14; E06C 7/16
See application file for complete search history.

(56) References Cited

U.S. PATENT DOCUMENTS 967,898 A * 8/1910 Gilmore ..... E04G 1/152 182/119
1,133,109 A 3/1915 Derbyshire
1,474,250 A * 11/1923 Folliard ..... E04G 1/30 248/172
2,206,314 A 7/1940 Werner
2,587,177 A 2/1952 Larson
2,587,377 A 2/1952 Penrose
2,723,073 A 11/1955 Fellowes
2,771,235 A 11/1956 Stephenson
2,793,386 A 5/1957 Muhlhauser
2,832,648 A 4/1958 Goosmann
3,128,842 A * 4/1964 Satrum ..... E04G 1/34 182/148
3,250,344 A * 5/1966 Romano ..... E06C 1/39 182/27
3,372,441 A 3/1968 Fisher
3,848,700 A 11/1974 Davis
3,997,024 A 12/1976 Fredricks
4,191,111 A 3/1980 Emmert
4,383,488 A 5/1983 Macho
4,524,902 A 6/1985 Mortimer
4,690,248 A 9/1987 Killeen
4,971,201 A 11/1990 Sathre
5,067,589 A 11/1991 Bartnicki
5,074,009 A 12/1991 Simonton
5,074,461 A 12/1991 Parker
5,096,019 A 3/1992 Kelsay
5,246,085 A 9/1993 Liegel
5,282,519 A 2/1994 Venturo
5,332,062 A 7/1994 Revere
5,462,221 A 10/1995 Zink
5,678,653 A 10/1997 Clinch
5,746,288 A 5/1998 O'Neal
5,950,972 A * 9/1999 Irish ..... E06C 7/14 248/210
5,984,047 A 11/1999 Rogers
6,017,106 A 1/2000 Adams
6,189,653 B1 2/2001 Laug
6,223,390 B1 5/2001 Lotufo
6,425,520 B1 7/2002 Peterson
D461,330 S 8/2002 Wang
6,427,804 B1 8/2002 Lazarus
6,619,540 B1 9/2003 Bazany
6,681,895 B2 1/2004 Virtue
D486,243 S 2/2004 Yamaoka
D486,244 S 2/2004 Yamaoka
D490,165 S 5/2004 Yamaoka
D495,426 S 8/2004 Yamaoka
6,808,105 B2 10/2004 Lee
6,892,860 B2 5/2005 Gibson
D536,799 S 2/2007 Freitas
7,210,560 B2 5/2007 Brink
7,516,704 B2 4/2009 Snider
7,549,381 B1 6/2009 Nail, Jr.
7,571,960 B2 8/2009 Williams
7,686,134 B1 * 3/2010 Harris ..... E06C 7/426 182/222
7,690,316 B2 4/2010 Yoo
8,042,653 B2 10/2011 Grebinoski
8,113,316 B2 2/2012 Sward
8,307,515 B2 11/2012 Ramsauer
8,307,769 B1 11/2012 Wescott
8,381,873 B2 2/2013 Cross
D704,858 S 5/2014 Green
8,727,074 B1 * 5/2014 Bhajan ..... E06C 7/165 182/120
8,777,683 B2 7/2014 Friedman
9,120,218 B1 9/2015 Stehlik
9,512,627 B2 12/2016 Taron
D776,826 S 1/2017 Foley
D781,083 S 3/2017 Zhu
9,752,334 B2 9/2017 Foley
10,343,274 B2 7/2019 Katz
10,450,799 B2 * 10/2019 Lawler ..... E06C 7/16
10,738,487 B2 8/2020 Woodward
D895,844 S 9/2020 Woodward
10,815,680 B2 10/2020 Woodward
10,858,848 B2 12/2020 Woodward
11,577,883 B2 2/2023 Ripplinger
2002/0162841 A1 11/2002 Shamir
2002/0178978 A1 12/2002 Wang
2003/0000770 A1 1/2003 Virtue
2003/0100421 A1 5/2003 Lee
2004/0238278 A1 12/2004 Gibson
2004/0238280 A1 12/2004 Gibson
2006/0130715 A1 6/2006 Yoo
2006/0169539 A1 8/2006 Grebinoski
2007/0101910 A1 5/2007 Haimoff
2007/0261916 A1 11/2007 Sward
2007/0289813 A1 12/2007 Bothwell
2009/0078165 A1 3/2009 Tseng
2009/0123736 A1 5/2009 Green
2009/0133959 A1 5/2009 Eriksson
2010/0071996 A1 3/2010 Huang
2010/0269302 A1 10/2010 Jagannathan
2010/0282540 A1 11/2010 Moss
2011/0056764 A1 3/2011 Cross
2012/0061182 A1 3/2012 Grimes
2013/0140110 A1 6/2013 Ken-Dror
2014/0290010 A1 10/2014 Friedman
2015/0267469 A1 9/2015 Markusen
2017/0044780 A1 2/2017 Foley
2017/0275899 A1 9/2017 Woodward
2017/0275900 A1 9/2017 Woodward
2018/0085912 A1 3/2018 Cindric
2018/0119434 A1 5/2018 Mikic
2018/0171648 A1 * 6/2018 Woodward ..... E04G 1/15
2018/0202177 A1 7/2018 Woodward
2019/0226217 A1 7/2019 Foley
2019/0387887 A1 12/2019 Yan
2021/0071433 A1 3/2021 Woodward
2022/0178153 A1 6/2022 Woodward
2023/0014482 A1 1/2023 Ramalho
2024/0368902 A1 11/2024 Woodward

FOREIGN PATENT DOCUMENTS

CN 103569460 2/2014
CN 205046823 2/2016
DE 202011050814 U1 * 1/2012 ..... B65D 19/0026
GB 2207453 A 2/1989
GB 2343883 5/2002
GB 2499186 A * 8/2013 ..... E04G 7/28
JP 2001224439 8/2001
JP 2002129744 5/2002
JP 2004323036 11/2004
JP 2005232707 9/2005

(56) References Cited

FOREIGN PATENT DOCUMENTS

| | | |
|---|---|---|
| JP | 2006022530 | 1/2006 |
| KR | 100714993 | 5/2007 |

OTHER PUBLICATIONS

Werner Co., "Werner #1 in Ladders, Climbing Equipment," Werner Catalog 2015, p. 41, 42, back page.
Werner Ladder Co, "Werner Ladder—AP-35 Aluminum PRO Linking Work Platform", published Oct. 26, 2017, URL: https://www.youtube.com/watch?v=tVYVyVwuSd4, (Apr. 10, 2018), XP002779894.

* cited by examiner

WORK PLATFORM AND METHOD

CROSS-REFERENCE TO RELATED APPLICATIONS

This is a nonprovisional of U.S. provisional patent application Ser. No. 63/273,127 filed Oct. 28, 2021; and is a continuation-in-part of U.S. patent application Ser. No. 17/863,220 filed on Jul. 12, 2022, both of which are incorporated by reference herein.

FIELD OF THE INVENTION

The present invention is related to an extendable work platform which, in a closed position, can be used as a scaffold. (As used herein, references to the "present invention" or "invention" relate to exemplary embodiments and not necessarily to every embodiment encompassed by the appended claims.) More specifically, the present invention is related to an extendable work platform, which in a closed position, can be used as a scaffold having a linkage which engages support structures to securely and stably hold the work platform in the closed position as a scaffold.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

A user commonly must adapt to the needs of the work environment. It is typically desirable to have a single product serve more than one function rather than to have multiple separate products having to serve multiple functions. In certain instances, a user requires a work platform and separately, a scaffold. It would be advantageous to have a single apparatus which serves as a work platform and also serves as a scaffold which can be securely engaged with a support structure to support the scaffold at a desired height without interfering with a user.

BRIEF SUMMARY OF THE INVENTION

The present invention pertains to a work platform. The work platform comprises a plank which telescopes to a desired width. The work platform comprises a first leg assembly rotatably attached adjacent to a first end of the plank. The work platform comprises a second leg assembly rotatably attached adjacent to a second end of the plank. The platform is in an open position when the plank is supported by the first leg assembly and second leg assembly and the first leg assembly and second leg assembly form an angle greater than 25 degrees with the plank. The platform is in a closed position when the first leg assembly and second leg assembly are adjacent to and in parallel with the plank.

The present invention pertains to a method for using a work platform. The method comprises the steps of extending a plank which telescopes of the work platform to a desired width determined by a distance between a first support structure and a second support structure separate and apart from the first support structure. There is the step of moving a first leg assembly of the work platform which is rotatably attached adjacent to a first end of the plank and a second leg assembly of the work platform which is rotatably attached adjacent to a second end of the plank from an open position, where the plank is supported by the first leg assembly and second leg assembly on ground and the first leg assembly and second leg assembly each form an angle greater than 25 degrees with the plank, to a closed position, where the first leg assembly and second leg assembly are adjacent to and in parallel with the plank. There is the step of placing the first end of the plank on the first support structure and the second end of the plank on the second support structure when the plank and the first leg assembly and second leg assembly are in a closed position.

The present invention pertains to a method for producing a work platform. The method comprises the steps of placing first supports of a first portion into hollow deck supports of a deck. The first supports able to move in and out of the deck supports. There is the step of placing a hook into one first support of the first supports, the hook able to move in and out of the one first support.

The present invention pertains to a method for using a work platform. The method comprises the steps of extending a plank which telescopes of the work platform to a desired width determined by a distance between a first support structure and a second support structure separate and apart from the first support structure. There is the step of moving a first leg assembly of the work platform which is rotatably attached adjacent to a first end of the plank and a second leg assembly of the work platform which is rotatably attached adjacent to a second end of the plank from an open position, where the plank is supported by the first leg assembly and second leg assembly on ground and the first leg assembly and second leg assembly each form an angle greater than 25 degrees with the plank, to a closed position, where the first leg assembly and second leg assembly are adjacent to and in parallel with the plank. There is the step of extending a first linkage from adjacent the first end of the plank. There is the step of engaging the first linkage with the first support structure and a second linkage adjacent the second end of the plank on the second support structure when the plank and the first leg assembly and second leg assembly are in a closed position to securely and stably hold the plank to the first support structure.

The present invention pertains to a method for producing a work platform. The method comprises the steps of rotatably attaching a first leg assembly to a first end of a plank of the work platform. There is the step of attaching a first linkage to a first leg of the first leg assembly, the first linkage adapted to secure the work platform to a first support structure.

DETAILED DESCRIPTION OF THE INVENTION

Figure 1:
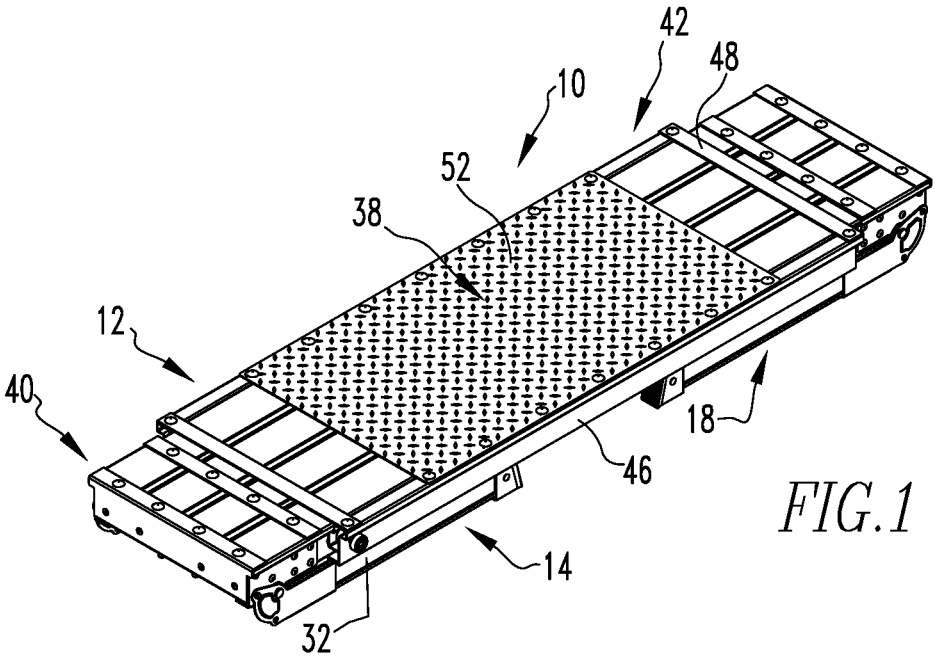
FIG. 1 shows the platform with the legs folded and the deck in the shortest retracted condition.
Figure 2:
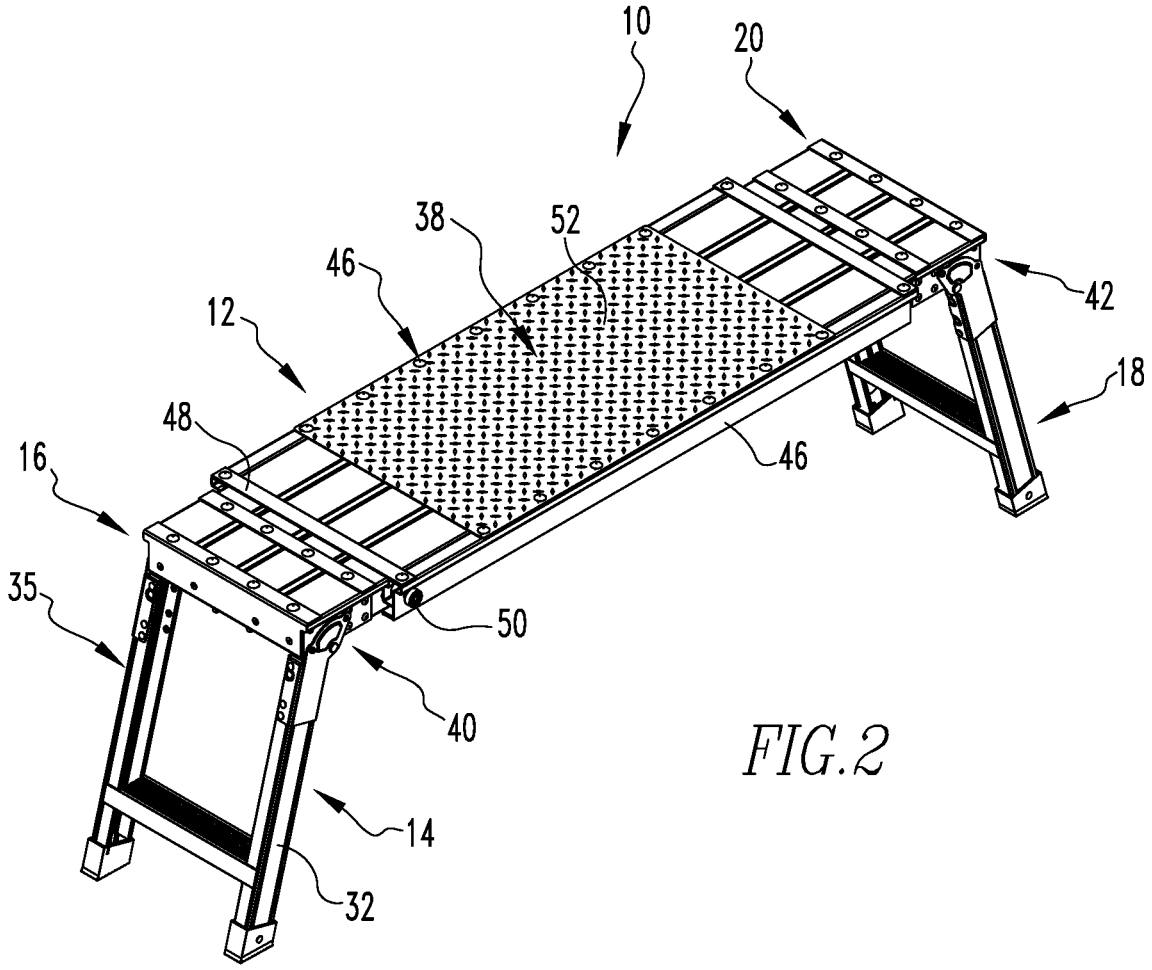
FIG. 2 shows the platform with the legs extended.
Figure 3:
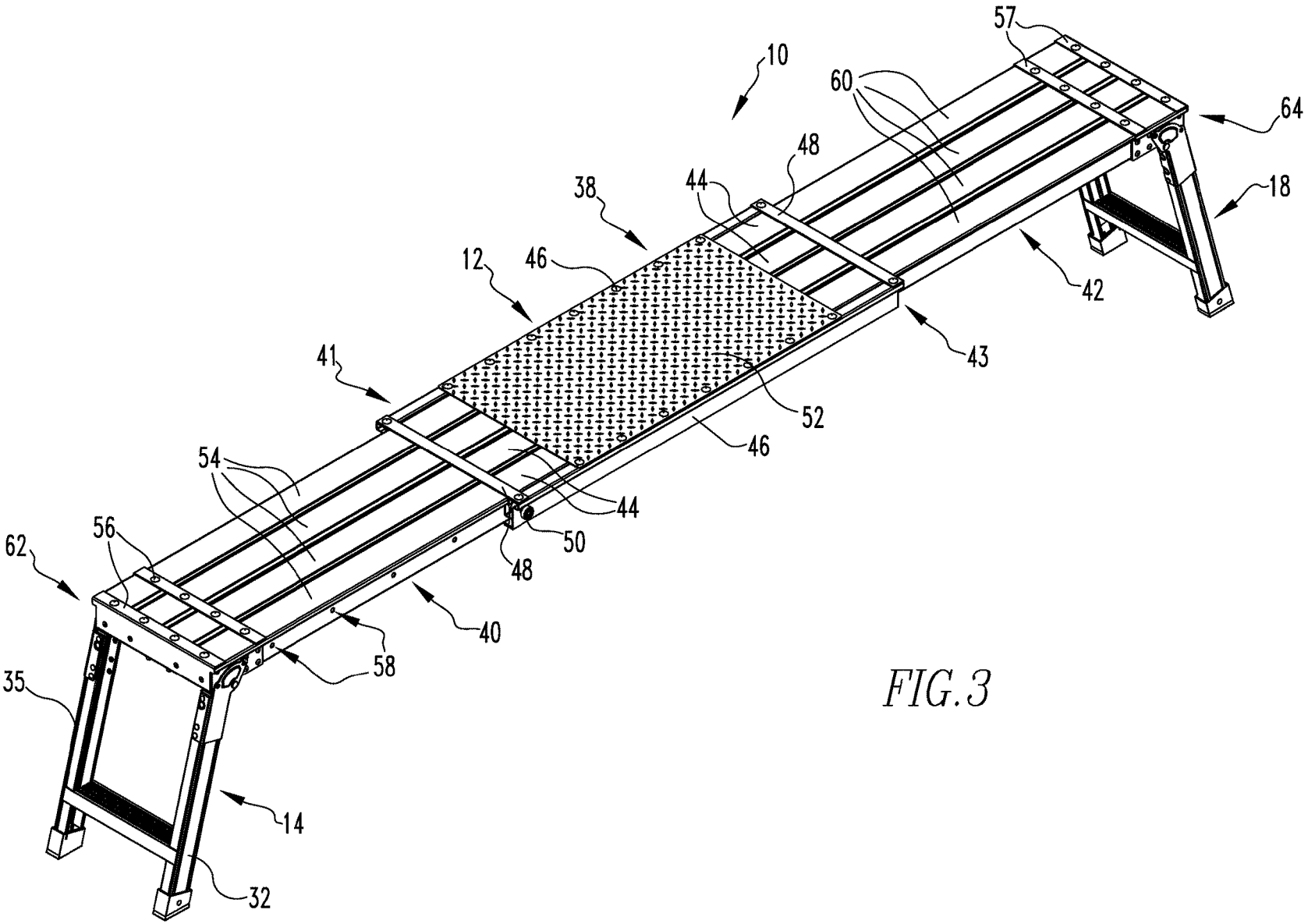
FIG. 3 shows the platform in the work platform mode and the deck 38 extended to its maximum length.
Figure 4:
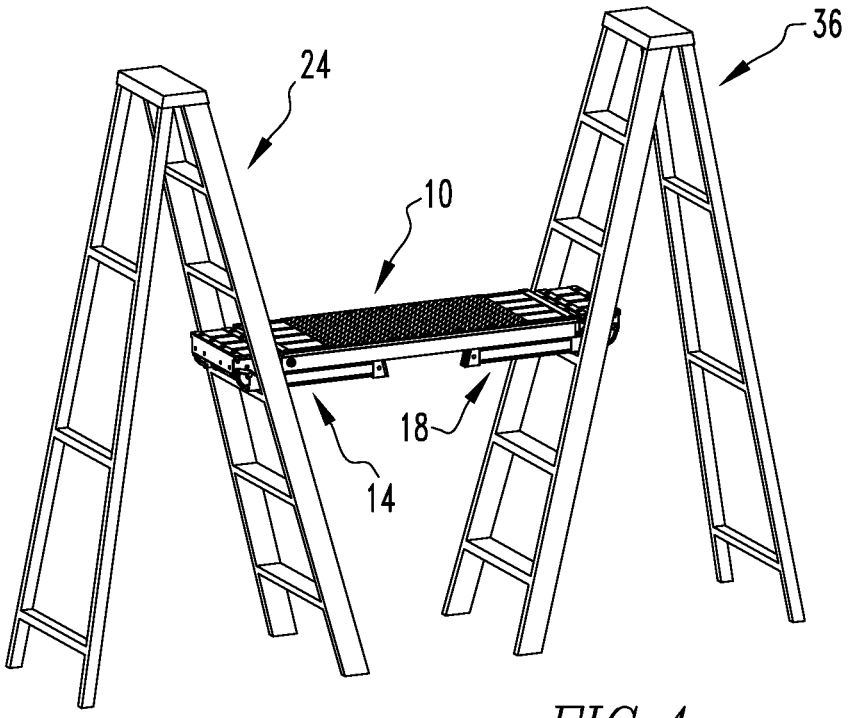
FIG. 4 shows the platform when used as a plank in its retracted condition.
Figure 5:
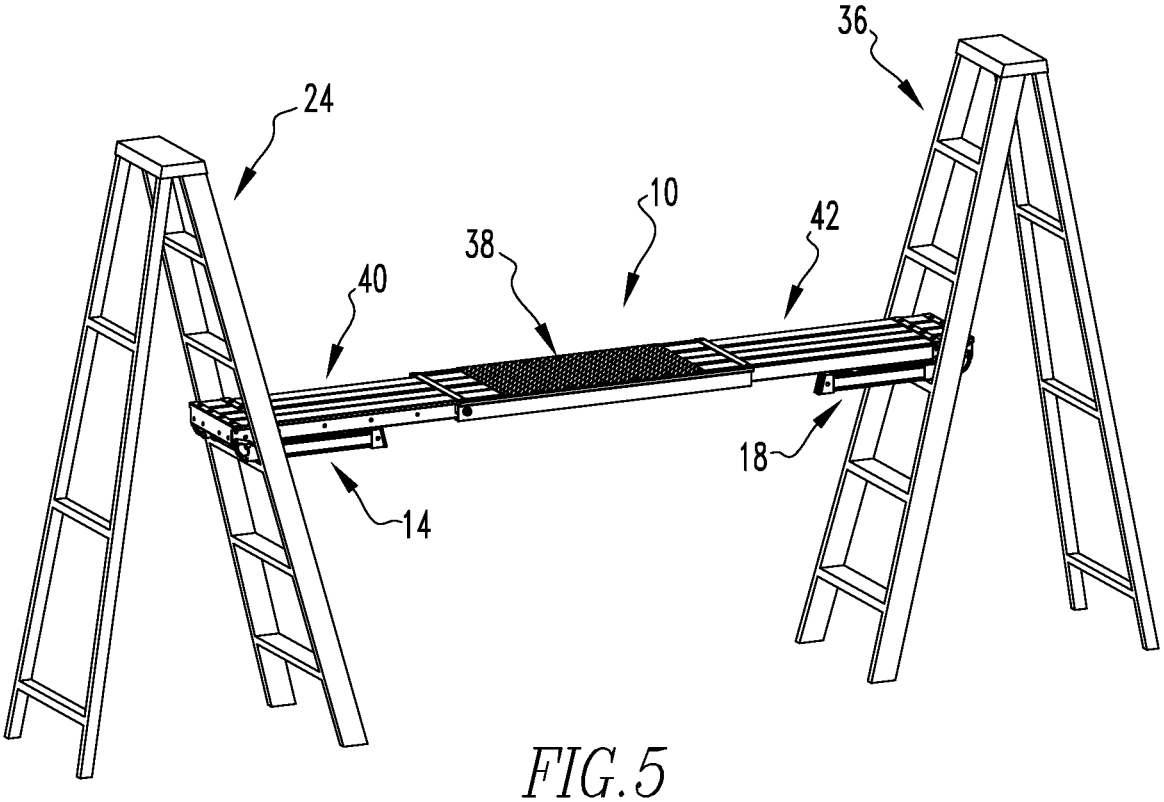
FIG. 5 shows the platform when used as a plank in its extended condition.

Referring now to the drawings wherein like reference numerals refer to similar or identical parts throughout the several views, and more specifically to FIGS. 1-5 thereof, there is shown a work platform 10. The work platform 10 comprises a plank 12 which telescopes to a desired width. The work platform 10 comprises a first leg assembly 14 rotatably attached adjacent to a first end 16 of the plank 12. The work platform 10 comprises a second leg assembly 18 rotatably attached adjacent to a second end 20 of the plank 12. The platform is in an open position when the plank 12 is supported by the first leg assembly 14 and second leg assembly 18 and the first leg assembly 14 and second leg assembly 18 form an angle greater than 25 degrees with the plank 12, as shown in FIGS. 2 and 3. The platform is in a closed position when the first leg assembly 14 and second leg assembly 18 are adjacent to and in parallel with the plank 12, as shown in FIGS. 1, 4 and 5.

The platform may include a first linkage 22 which extends from adjacent the first end 16 of the plank 12 adapted to engage a first support structure 24 to securely and stably hold the plank 12 to the first support structure 24, as shown in FIGS. 6, 6A, 7 and 7A, 8 and 9. The first linkage 22 may be a first hook 26 which extends from the first end 16 of the plank 12. The first hook 26 may be part of a handle 28 which extends from the first end 16 of the plank 12, as shown in FIGS. 10, 10A, 11, 11A and 12. The platform may include a spring 30 which biases the handle 28 to a closed position with the plank 12 when the first hook 26 is apart from the first support structure 24. Alternatively, first leg assembly 14 may include a first leg 32 having a first recess 34 which is adapted to fit onto an engage the first support structure 24, as shown in FIGS. 13, 13A, 14, 14A and 15.

The first leg assembly 14 may include a second leg 35 in parallel with and in spaced relation with the first leg 32, as shown in FIGS. 2 and 3. There may be a step 70 extending between and attached to the first leg and the second leg. The second leg assembly 18 may include a first leg and a second leg in parallel with and in spaced relation with the first leg of the second leg assembly 18, and may have a step extending between and attached to the first leg and the second leg of the second leg assembly 18. The first and second leg assemblies may be rotatably attached to the plank so the legs are disposed outside of the perimeter of the plank. See U.S. Pat. No. 10,848,858, incorporated by reference herein, for a description of leg assemblies which may be rotatably attached to the plank so the legs are disposed outside of the perimeter of the plank.

The present invention pertains to a method for using a work platform 10. The method comprises the steps of extending a plank 12 which telescopes of the work platform 10 to a desired width determined by a distance between a first support structure 24 and a second support structure 36 separate and apart from the first support structure 24. There is the step of moving a first leg assembly 14 of the work platform 10 which is rotatably attached adjacent to a first end 16 of the plank 12 and a second leg assembly 18 of the work platform 10 which is rotatably attached adjacent to a second end 20 of the plank 12 from an open position, where the plank 12 is supported by the first leg assembly 14 and second leg assembly 18 on ground and the first leg assembly 14 and second leg assembly 18 each form an angle greater than 25 degrees with the plank 12, to a closed position, where the first leg assembly 14 and second leg assembly 18 are adjacent to and in parallel with the plank 12. There is the step of placing the first end 16 of the plank 12 on the first support structure 24 and the second end 20 of the plank 12 on the second support structure 36 when the plank 12 and the first leg assembly 14 and second leg assembly 18 are in a closed position.

The placing step may include the steps of engaging a first linkage 22 from adjacent the first end 16 of the plank 12 with the first support structure 24, and engaging a second linkage 23 from adjacent the second end 20 of the plank 12 with the second support structure 36 so the plank 12 is securely and stably held to the first and second support structures 24, 36. The engaging the first linkage 22 step may include the step of moving a first hook 26 outwards from the first end 16 of the plank 12. The engaging the second linkage 23 step may include the step of moving a second hook 27 outwards from the first end 16 of the plank 12. Alternatively, the placing step may include the step of engaging a first recess 34 of a first leg of the first leg assembly 14 and a second recess 33 of a second leg of the first leg assembly 14 with the first support structure 24 so the plank 12 is securely and stably held with the first and second port structures. The first support structure 24 may be a rung of a ladder.

The present invention pertains to a method for producing a work platform. The method comprises the steps of placing first supports of a first portion into hollow deck supports of a deck, the first supports able to move in and out of the deck supports. There is the step of placing a hook into one first supports of the first supports, the hook able to move in and out of the one first support.

This invention is an extendable work platform 10 with folding legs which can also be used as a telescoping plank 12 between supporting structures when the legs are folded, as shown in FIGS. 1-5. The width of the plank 12 enables it to be placed between the legs of conventional ladders. The present disclosure is an extendable plank 12 with leg assemblies which can be used as a work platform 10, or used as a scaffold placed between two support structures, such as to ladders on their steps 65, with the leg assemblies folded up. Such an apparatus may be referred to as a plankform. The platform 10 supports at least 250 pounds of load in the open extended position, and even more than 500 pounds of load without failing when it is in the open extended position or being used as a scaffold in the extended position and supported on either side, as described herein, preferably by a step 65 of a first ladder and a step 65 of a second ladder.

In one embodiment, retractable hooks extend from the end of the plank 12 which fit over the rungs, steps, etc., which the plank 12 will rest on, as shown in FIGS. 6-9.

Figure 10A:
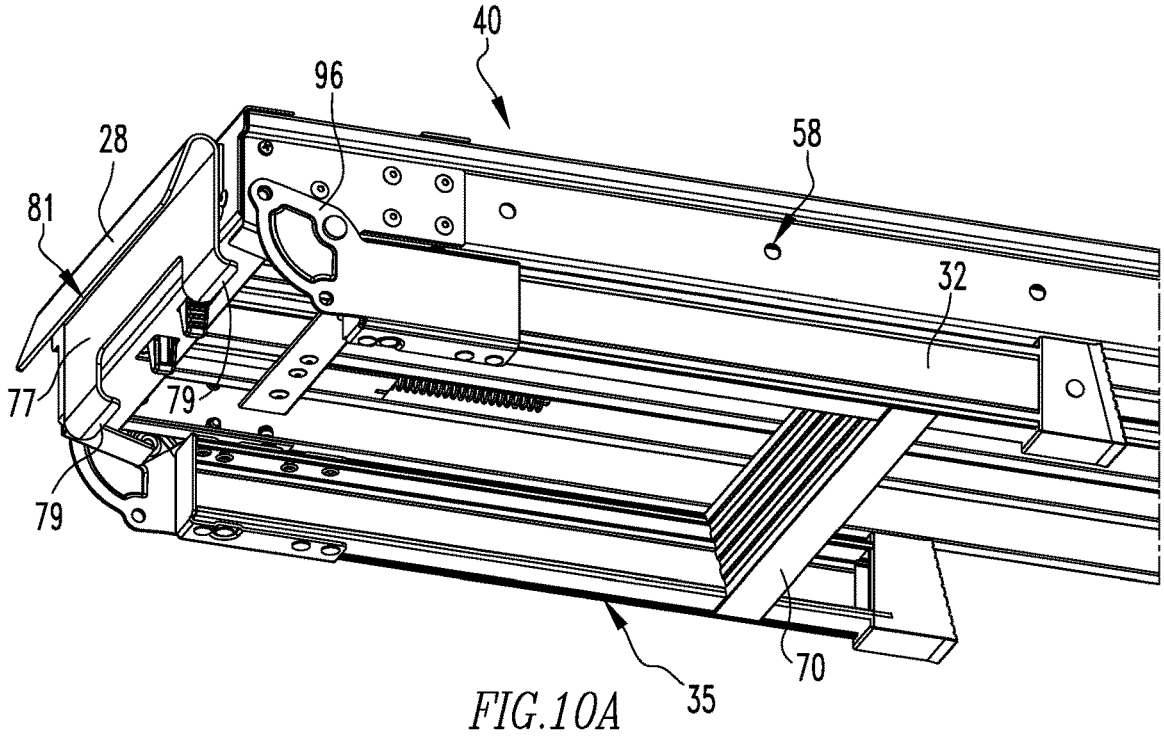
FIG. 10A is a bottom perspective view of the first portion with the handle and hooks in a retracted position.
Figure 10:
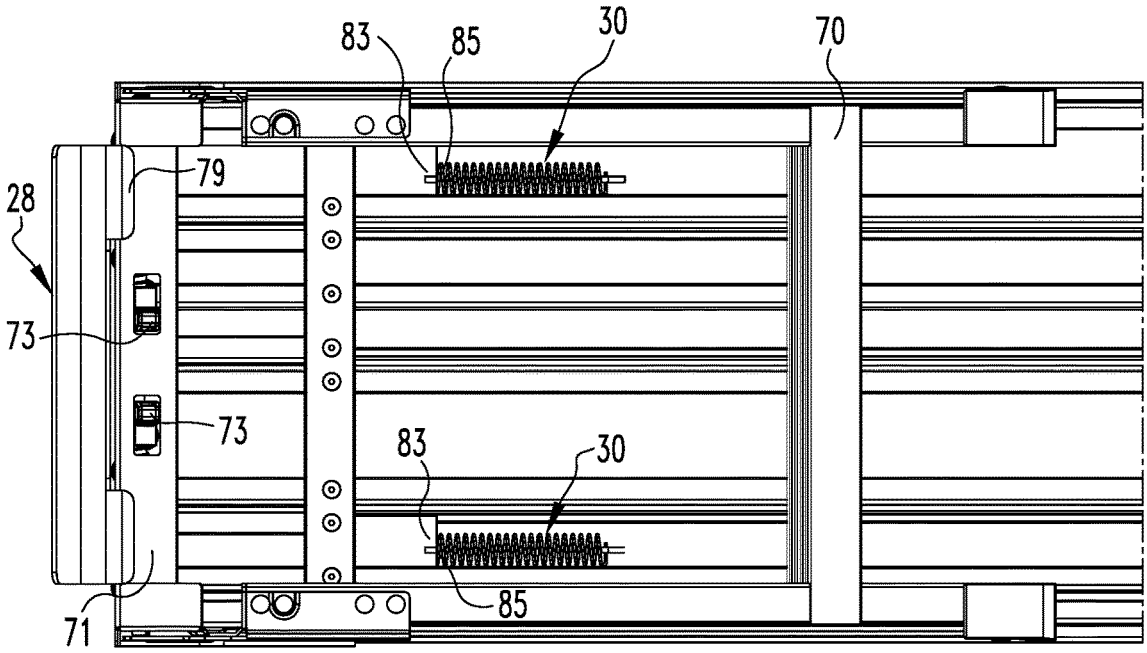
FIG. 10 shows a further embodiment in which springs tend to cause the hooks to retract and a handle with its own hooks connects the ends of the hooks.
Figure 11A:
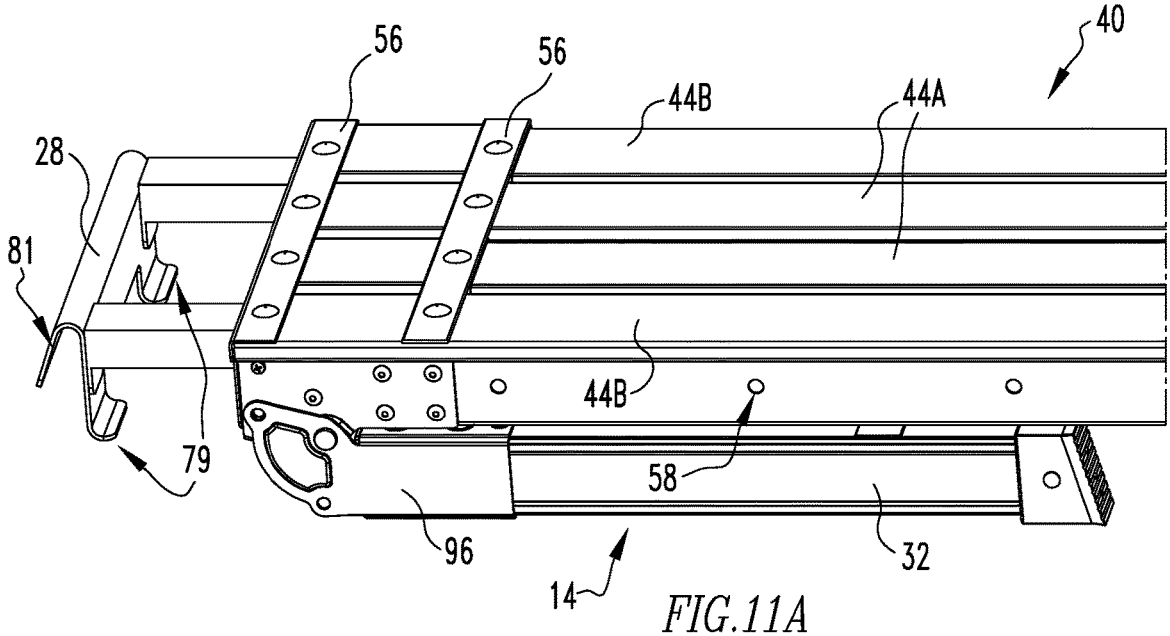
FIG. 11A is an overhead perspective view of the first portion with the handle and hooks in an extended position
Figure 11:
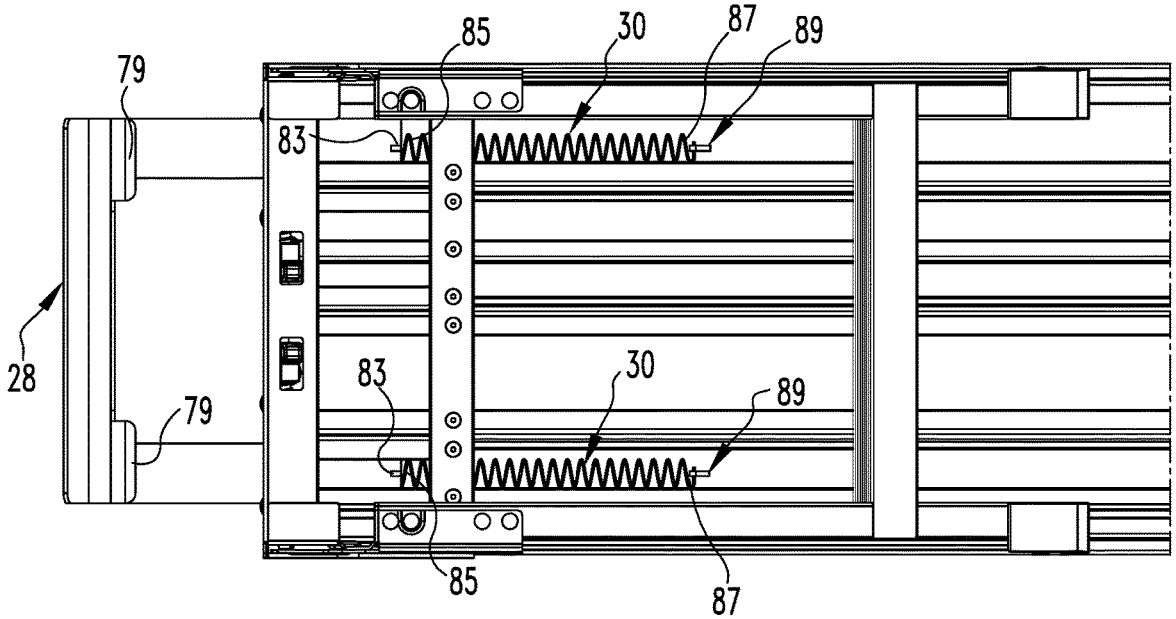
FIG. 11 is a bottom view of the embodiment of FIG. 10.
Figure 12:
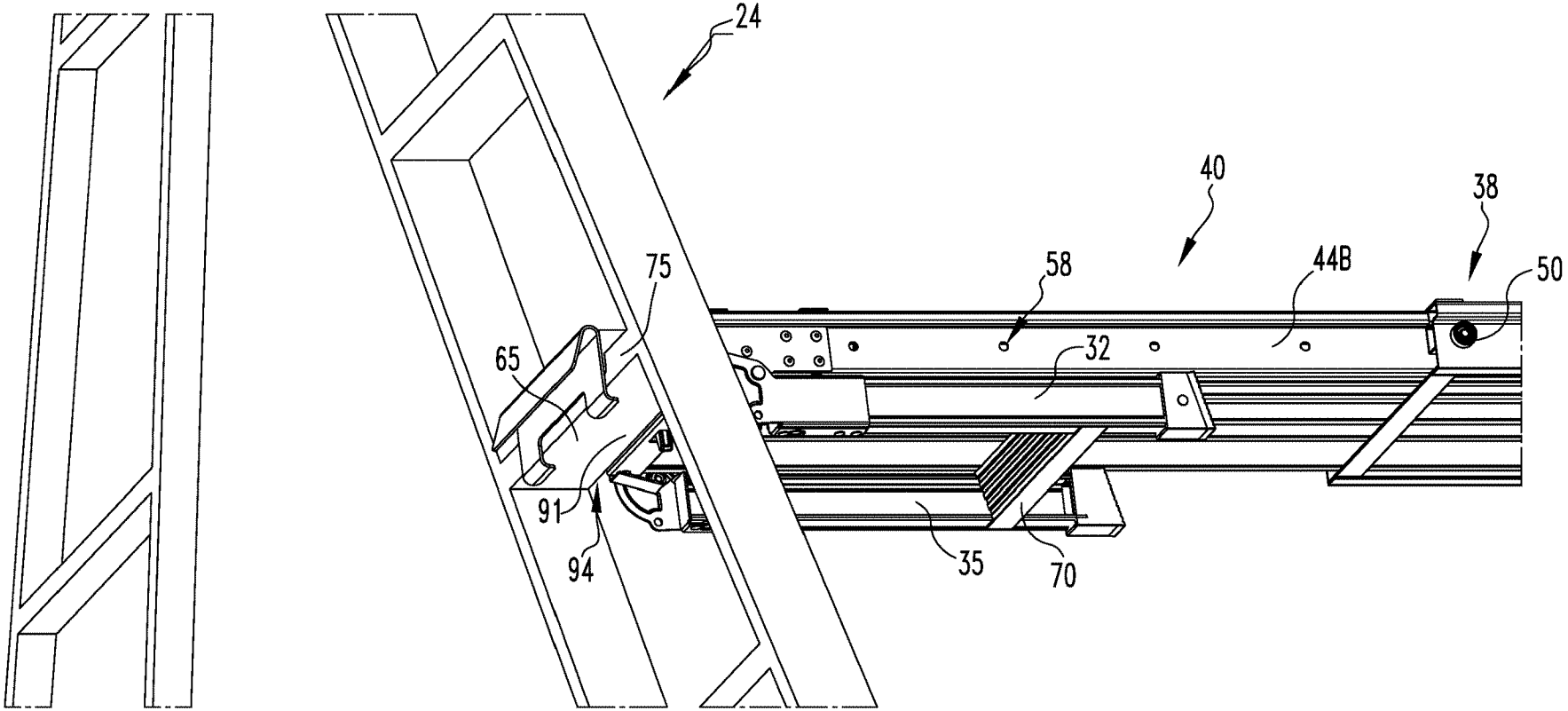
FIG. 12 shows the platform of FIG. 10 laid onto its supports.

In another embodiment, the hooks are spring-loaded which draw the plank 12 into snug engagement with its supports, as shown in FIG. 10-12, with or without a handle 28.

Figure 13:
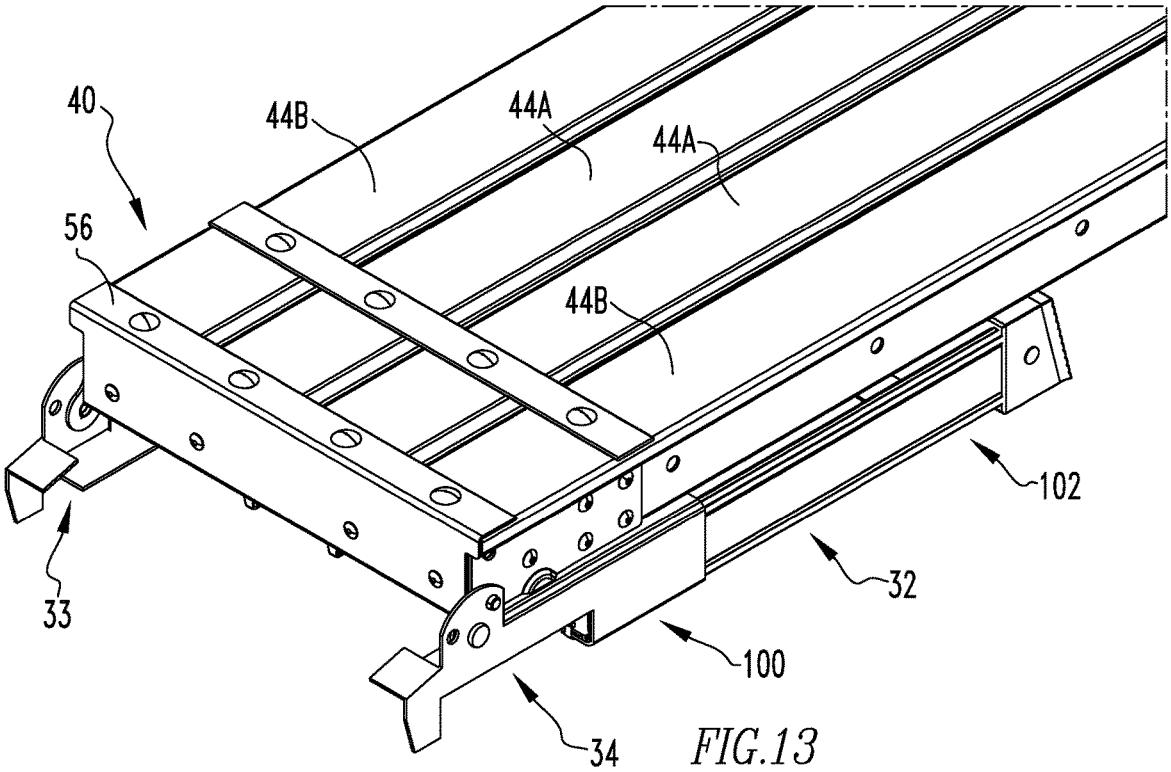
FIG. 13 shows how recesses are formed in the legs which are positioned to engage the platform support surfaces when the legs are in the folded position.
Figure 14:
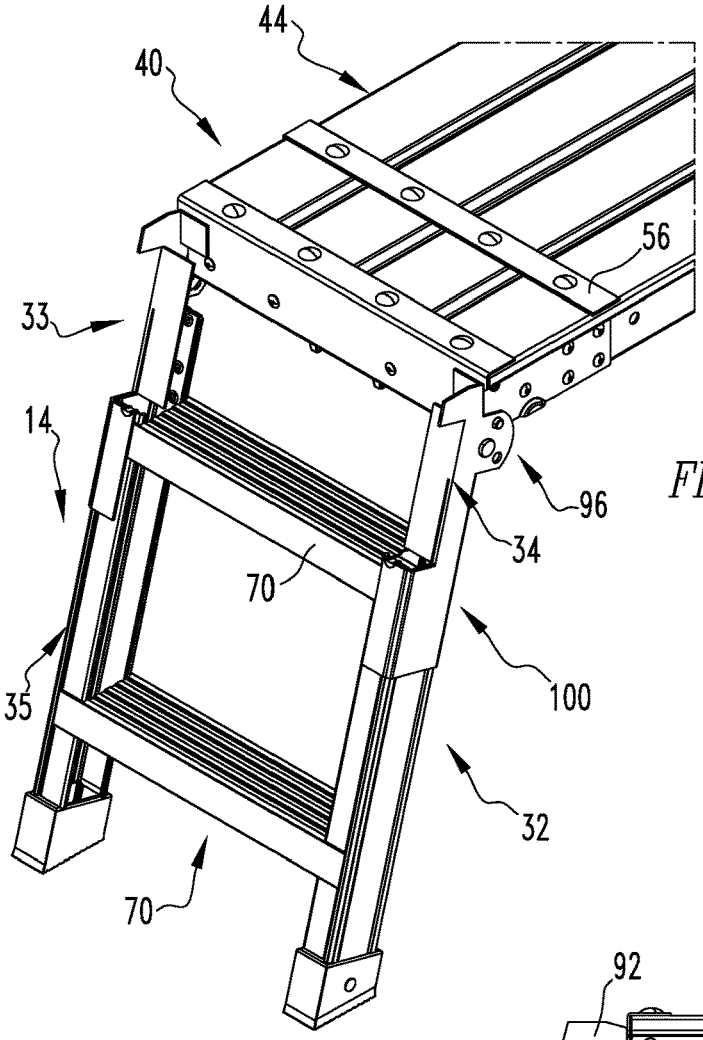
FIG. 14 shows how recesses are formed in the legs which are positioned to engage the platform support surfaces when the legs are in the open position.
Figure 15:
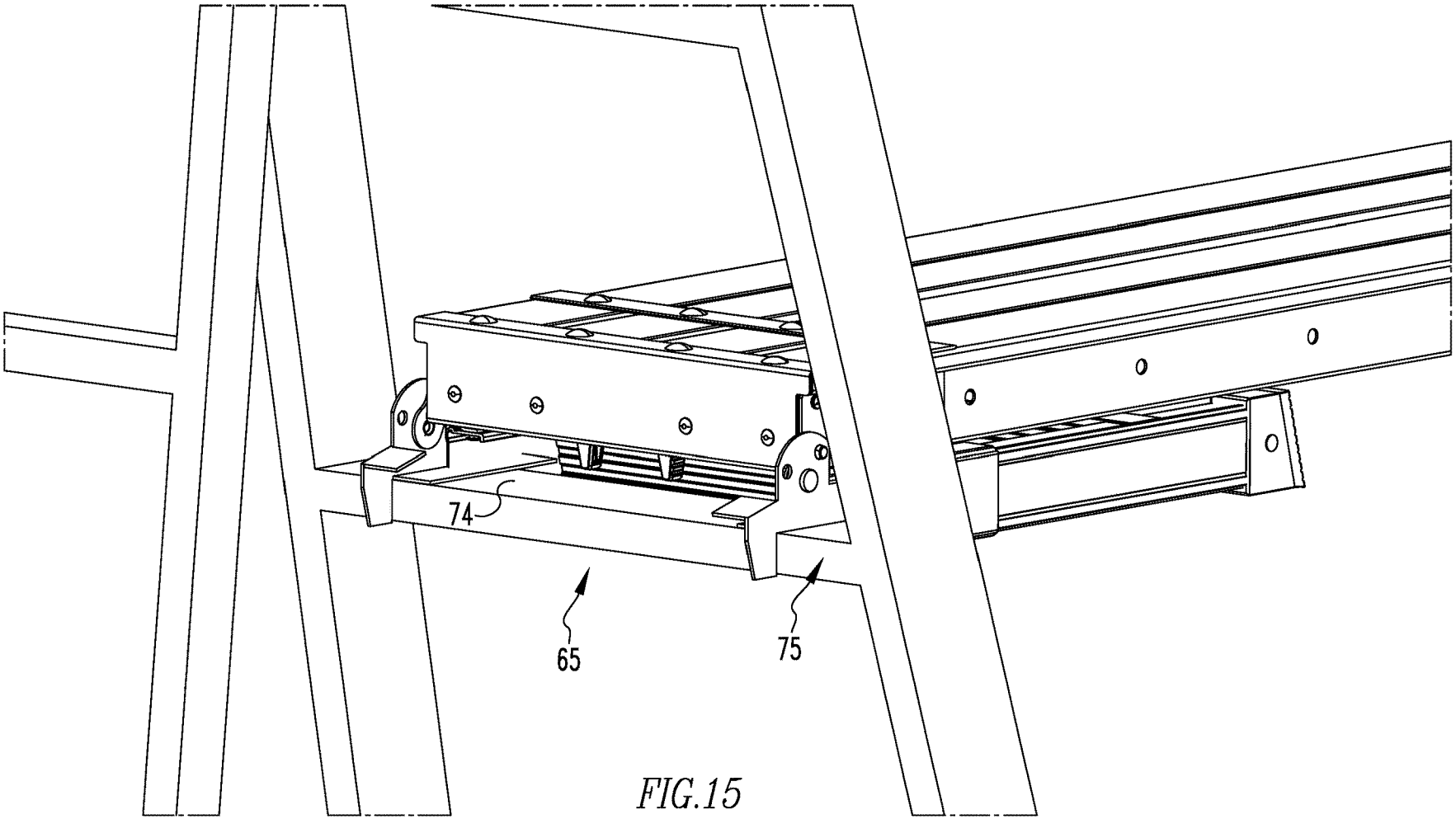
FIG. 15 shows the platform supported by a ladder with the recesses engaged with the ladder steps.

In another embodiment, recesses are formed in the platform 10 legs which are used to engage the support, as shown in FIGS. 13-15.

This invention enables the user to adapt to the needs of the work environment without needing two separate products. Its length in either mode of use is adjustable between 4' and 8' which enables the user to work in a large area without having to relocate his or her plank 12/work platform 10.

Additionally, the embodiment of extendable hooks permits 100% of the plank 12 standing area to be used, and the hooks provide very solid engagement with the plank 12 support surface.

FIG. 1 shows the platform 10 in the closed position with the legs folded and the plank 12 in the shortest retracted position. In this state, the platform 10 can be easily transported or stored. The plank 12 is preferably comprised of a deck 38, a first portion 40 which extends and retracts from a first side 41 of the deck 38, and a second portion 42 which extends and retracts from a second side 43 of the deck 38, as shown in FIG. 3. The deck 38 itself is comprised of a plurality of hollow deck supports 44 of the same dimensions, having either a rectangular or C shaped cross-section, which are in parallel and adjacent with each other and fixed together. Here, there are four deck supports 44 attached together, with two interior deck supports 44 and two exterior deck supports 44. On either side of the outside of both exterior deck supports 44 is a side bracket 46 which extends the length of the exterior deck support it is alongside. Extending perpendicular from and attached adjacent each end of the side brackets 46 is a top deck bracket 48. The top deck bracket 48 fits over the deck supports 44 and does not block any portion of the hollow interior of the deck supports 44. Adjacent one end of each side bracket 46 is fixed a lock 50 to lock the first portion 40 and the second portion 42 at a desired position relative to the deck 38. An example of a type of lock that can be used as described in U.S. Pat. No. 5,067,589, incorporated by reference herein. A flat serrated metal plate 52 may be positioned atop the deck supports 44 and attached to both side brackets 46.

The first portion 40 is comprised of four first supports 54 which are attached together like the deck supports 44, although each of the first supports 54 has a cross-section which is smaller than the cross-section of the deck supports 44 so the first supports 54 can fit into and slide in and out of the deck supports 44. One first support fits into one deck support. The first supports 54 are aligned and fitted into the deck supports 44 at the first side 41 of the deck 38. There may be one or more top first brackets 56 fitting over the first supports 54 and attached to the first supports 54 between the two external first supports 54 to fix the first supports 54 together.

There are locking holes 58 present at regular intervals on the outside of the external first support which is adjacent the lock 50 on the side bracket 46. The lock 50 fits into the desired locking hole to lock the first portion 40 at a desired position relative to the deck 38. The second portion 42 is comprised of four second supports 60 and are configured and operate in the same way as the first portion 40 and with respect to the deck 38. There may be one or more top second brackets 57 fitting over the second supports 60 and attached to the second supports 60 between the two external second supports 60 to fix the second supports 60 together.

The first leg assembly 14 is rotatably attached adjacent to the outer end 62 of the first portion 40 and the second leg assembly 18 is rotatably attached adjacent to the outer end 64 of the second portion 42. The length of the first supports 54 and the length of the second supports 60 are generally slightly less than half the length of the deck supports 44 so when the first and second supports 54, 60 are moved into the retracted position, the first and second supports 54, 60 do not block each other from fitting all the way into the deck supports 44. The top first bracket also may act as a stop when it abuts the top deck bracket 48 at the first side 41 of the deck 38 when the first portion 40 is moved into the deck 38. In the same way the top second bracket may also act as a stop when it abuts the top deck bracket 48 at the second side 43 of the deck 38 when the second portion 42 is moved into the deck 38.

FIG. 2 shows the platform 10 with the legs extended and the plank 12 in a retracted position. In this mode, the platform 10 can be used as a conventional work platform 10.

FIG. 3 shows the platform 10 in the work platform 10 mode and the plank 12 in an extended position where it is extended to its maximum length.

FIGS. 4 and 5 show the platform 10 when used as a scaffold with the plank 12 in its retracted and extended conditions, respectively. It is shown resting on the steps 65 of stepladders but could also be used with roof jacks, scaffolds, etc., in the manner which conventional planks are used.

Figure 6:
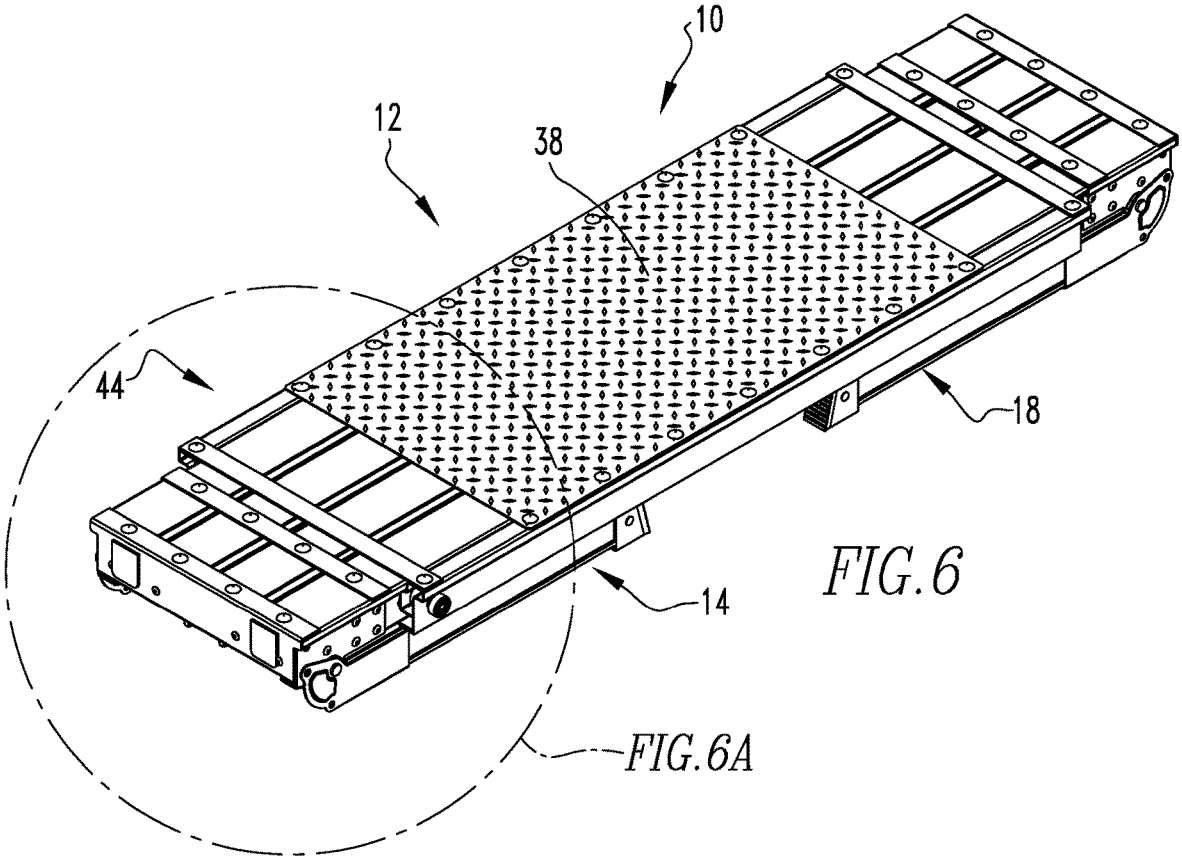
FIG. 6 shows an additional feature of this invention. Hooks are mounted in the platform at both ends which can be moved to a stowed position.
Figure 6A:
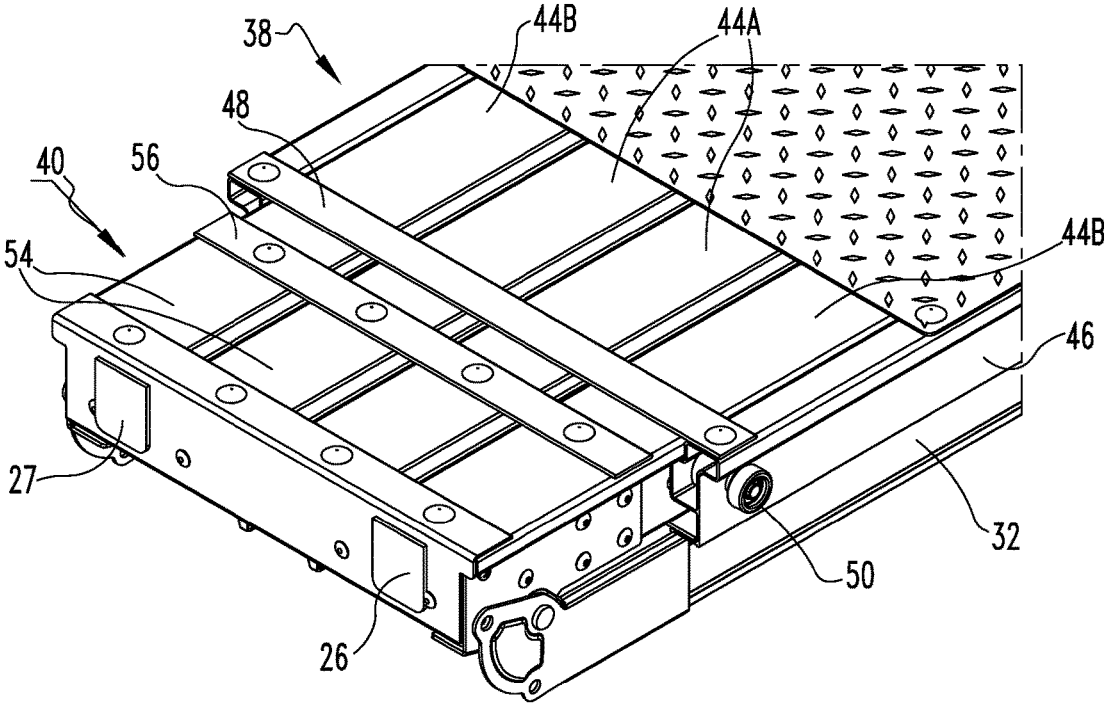
FIG. 6A is a sectional view of A of FIG. 6.
Figure 7:
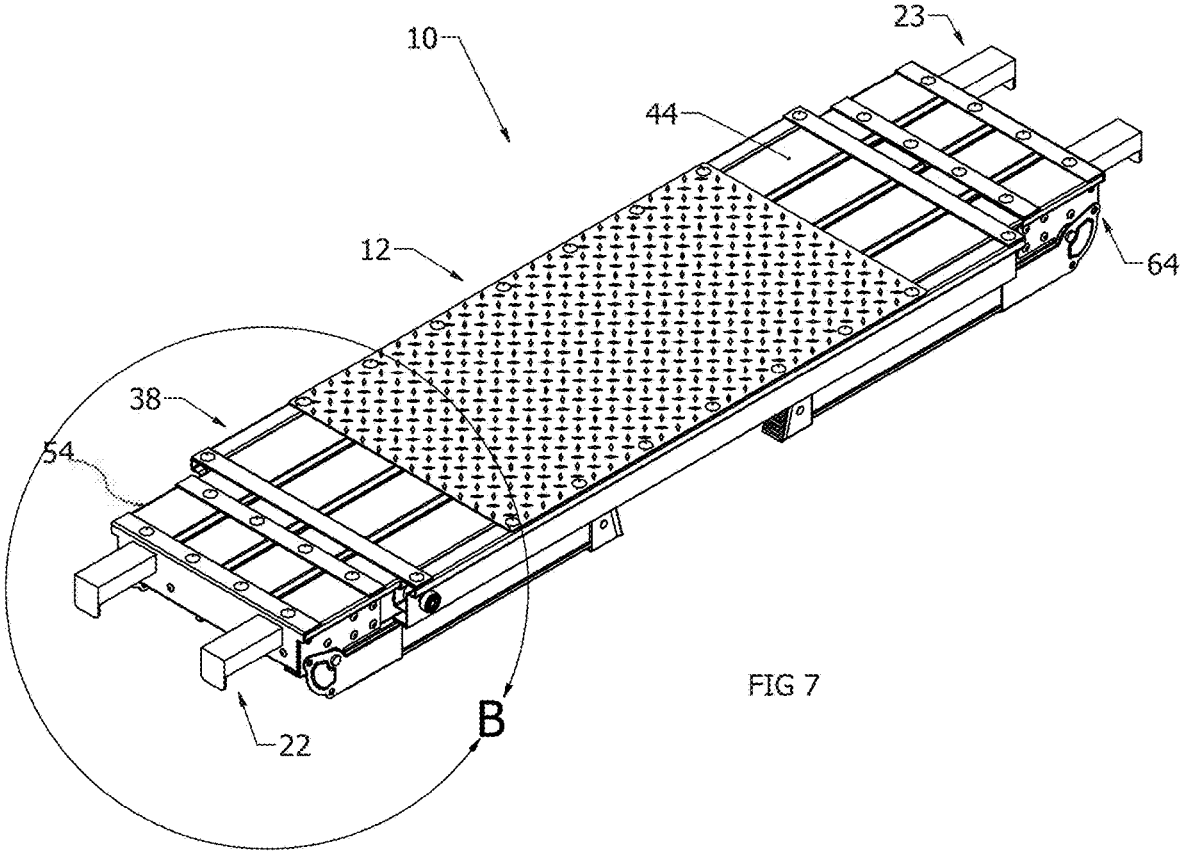
FIG. 7 shows the hooks mounted in the platform at both ends which can are moved to a deployed position.
Figure 7A:
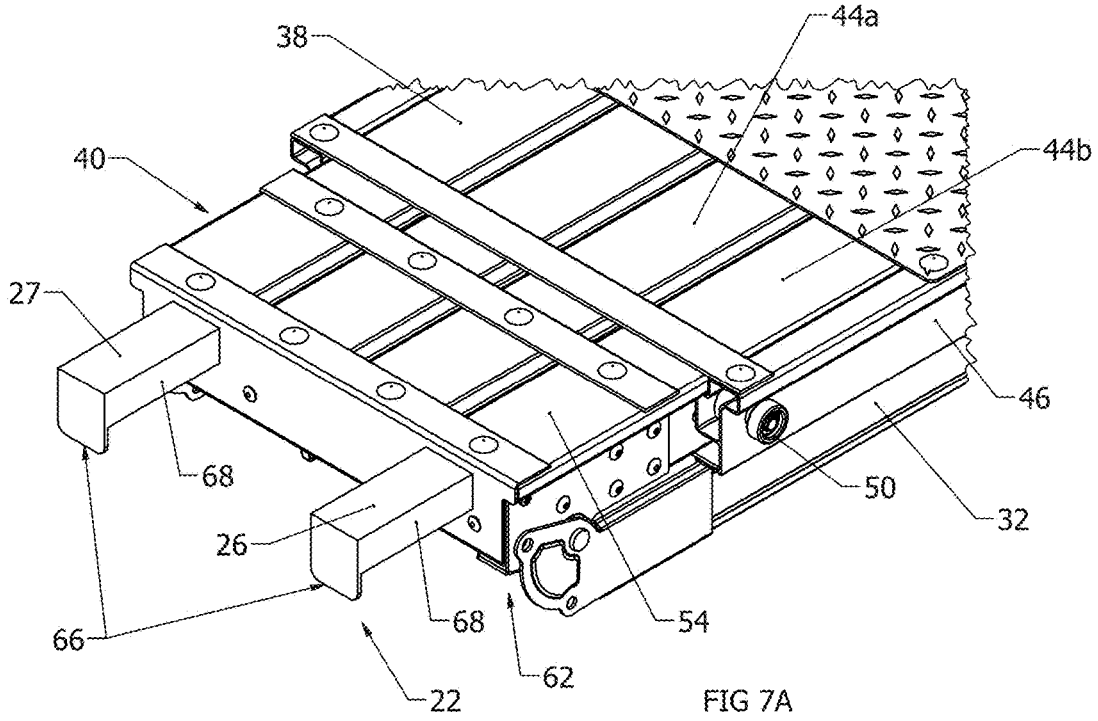
FIG. 7A is a sectional view of A of FIG. 7.

FIGS. 6, 6A, 7 and 7A show an additional feature of this invention. Hooks are mounted in the platform 10 at both ends which can be moved to a stowed position, as shown in FIGS. 6 and 6A, or a deployed position, as shown in FIGS. 7 and 7A. Notice that the hooks have overhanging ends 66, as shown in FIG. 7A. In this embodiment, there are four separate hooks, each independent from the other. There are two hooks which extend from the outer end 62 of the first portion 40 and two hooks which extend from the outer end 64 of the second portion 42. Each hook of the first portion 40 fits in and is able to slide back and forth in an external first support, and each hook of the second portion 42 fits in and is able to slide back and forth in an external second support. Each hook is formed of a stem 68 which fits into the respective external first or second support, and an overhanging end 66, which is a flat rectangular plate attached to the stem 68 which extends below the bottom of the stem 68. In a stowed position, as shown in FIG. 6 and FIG. 6A, the stem 68 of each hook fits completely within the respective first or second support, and the overhanging end 66 fits on the surface of the respective outer end of the first or second portion. The overhanging end 66 acts as a stop, preventing the hook from going too far into the respective external first or second support, catching on the outer end of the respective portion. Extending up from the base 71 of the outer end 62, in the path of the hook, is a screw against which the inner end 87 of the stem 68 contacts, which acts as a stop that prevents the stem 68 from coming out of the first or second portion when the hook is pulled out and deployed, as shown in FIGS. 7 and 7A. Extending through the base 71 of the outer end 62 are the levers 73 of the hinge release mechanism, as shown in FIG. 10, which withdraw locking bars from the hinges of the leg assemblies, as is well known in the art.

Figure 8:
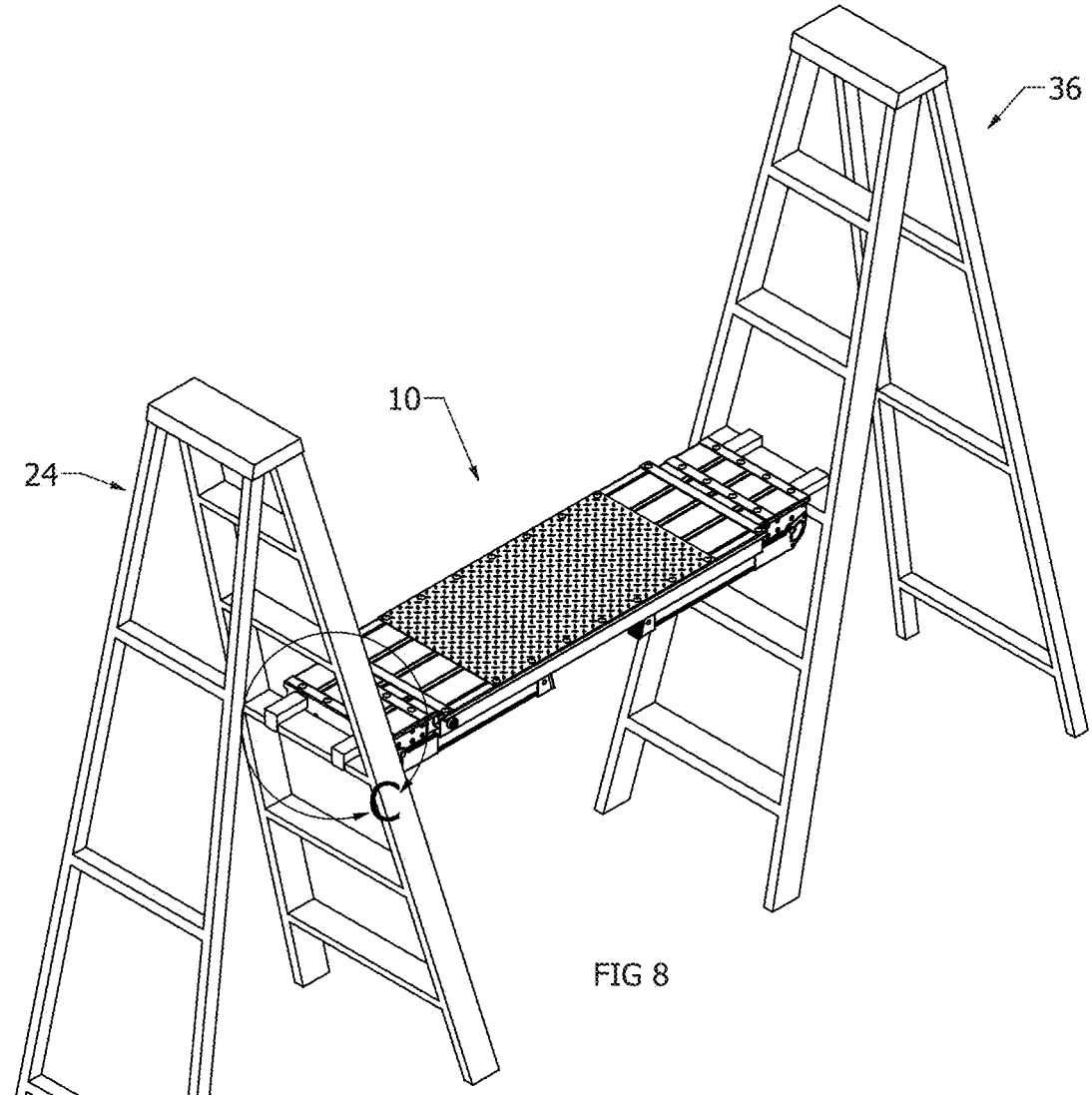
FIG. 8 shows how the hooks engage with the steps of stepladders when the platform is in the retracted position.
Figure 8A:
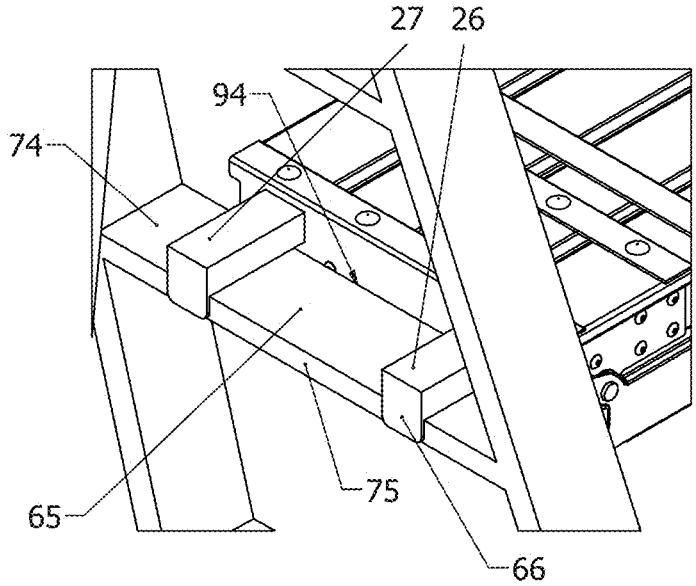
FIG. 8A is a sectional view of A of FIG. 8.
Figure 9:
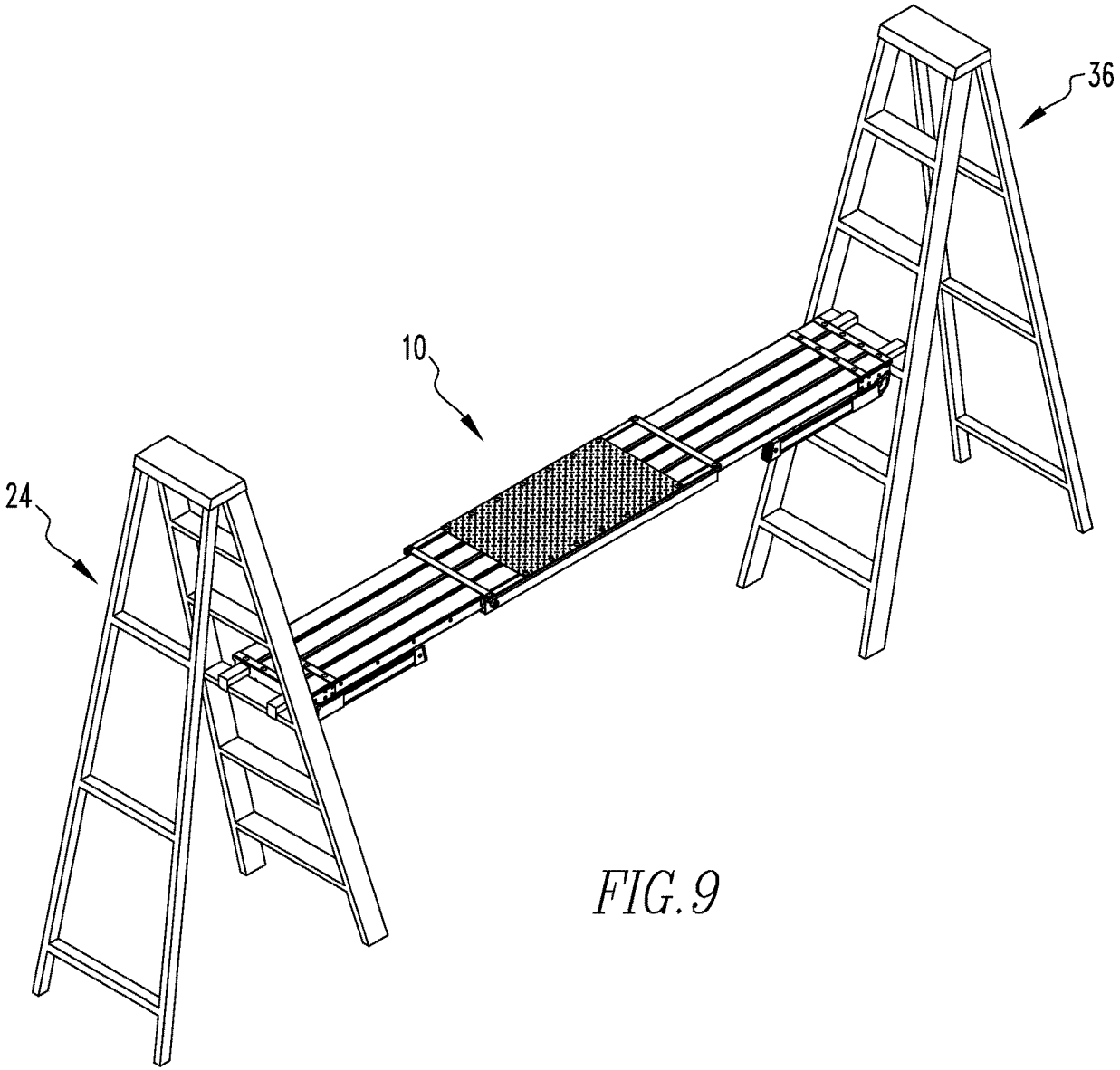
FIG. 9 shows how the hooks engage with the steps of stepladders when the platform is in the extended position.

FIGS. 8 and 9 show how the hooks engage with the steps 65 of stepladders. When used this way, the full length of the platform 10 can be used by the user and the platform 10 is securely held in place by the overhanging ends of the hooks. FIG. 8 shows the platform 10 in the retracted position with the hooks deployed from the first portion 40 positioned on a step 65 at a desired height of a first ladder, and with the hooks deployed from the second portion 42 positioned on a step 65 at the same height of a second ladder. As shown in FIG. 8A, the stems 68 of the hooks rest flat on the top surface 74 of the steps 65 and the overhanging ends extend down from the top surface 74 of the steps 65 and ideally contact the interior sides 75 of the steps 65. In this way, the platform 10 stably and securely is positioned at a desired height with the support of the first and second ladders so users may climb on top of the platform 10. In the same way, the platform 10 in an extended position is supported by the first and second ladders, as shown in FIG. 9. The hooks will also permit the platform 10 to engage ladder jacks, roof jacks, scaffolds, etc.

FIGS. 10, 10A, 11 and 11A show a further embodiment in which springs 30 tend to cause the hooks to retract and a handle 28 with its own hooks connects the ends of the hooks. In the further embodiment, both hooks on the same portion of the platform 10 are attached to a handle 28 at their overhanging ends. The handle 28 is preferably one piece with a base 77 that is flat and is welded to the overhanging ends and extends between the two hooks and preferably not beyond them. At the bottom of the base and extending below the overhanging ends in the first and second portions are arcs 79 which curve downwards and inwards from the base 77. At the top of the base, preferably extending along the length of the base 77 is a handle flange 81 which angles outwards and downwards, between 10° and 70° and preferably about 30° from the base 77.

The stems 68 of the hooks engage with and fit into the supports in the same way as they do in the embodiment described above where the hooks are separate and apart from each other. However, in this embodiment, the internal end 83 of each stem 68 is fixed to the outer end 85 of a handle spring, as shown in FIG. 10 and FIG. 11. The inner end 87 of the handle spring is fixed to a spring bracket 89 extending down from the inner surface of the respective support of the first or second portions. In use, the user pulls the handle 28 outward, extending the hooks against spring force. When the platform 10 has been laid onto its supports as seen in FIG. 12, the handle 28 is released which allows the hooks to retract by the force of the springs 30 and the arcs 79 to positively engage the step 65 of the ladder. The arcs 79 of the handle 28 fit under and contact the bottom surface 91 of the step 65, with the base 77 contacting the interior side 75 of the step 65 to securely and stably hold the platform 10 in the desired position. The springs 30 act as stops preventing the hooks from being pulled out of the first supports 54, or second supports 60. FIG. 10 shows a bottom view of the first portion 40 with the handle 28 and hooks in a retracted position. FIG. 11 shows a bottom view of the first portion 40 with the handle 28 and hooks in an extended position. FIG. 10A is a bottom perspective view of the first portion 40 with the handle 28 and hooks in a retracted position. FIG. 11A is an overhead perspective view of the first portion 40 with the handle 28 and hooks in an extended position. FIG. 12 is a bottom perspective view of the first portion 40 with the handle 28 extended and engaged with the step 65.

FIGS. 13, 13A, 14 and 14A show yet another embodiment with recesses formed in the legs which are positioned to engage the platform 10 support surfaces when the legs are in the closed position. FIG. 15 shows the platform 10 supported by a ladder with the recesses engaged with the ladder steps 65.

In this embodiment, there are no hooks in the plank 12. Instead, recesses adjacent the top of each leg serve to stabilize the plank 12 on the steps 65 of the support ladders. Each recess has a shape which conforms with the top and interior and exterior sides of the step 65. Each recess has a long portion 90 which is straight and rests on the top surface of the step 65. At each end of the long portion 90, a side portion 92 extends perpendicularly from the long portion 90. The side portion 92 adjacent the top of the leg fits over the interior side 75 of the step 65 and the other side portion 92 fits over the exterior side 94 of the step 65 when the platform 10 is placed on the steps 65, as shown in FIG. 15. The side portion 92 adjacent the top of the leg hooks with the interior side 75 of the step 65, preventing the plank 12 from being pulled away from the step 65, and the other side portion 92 hooks with the exterior side 94 of the step 65, which prevents the plank 12 from moving toward the interior of the ladder, thus preventing plank 12 from moving forward or back relative to the step 65.

Figure 13A:
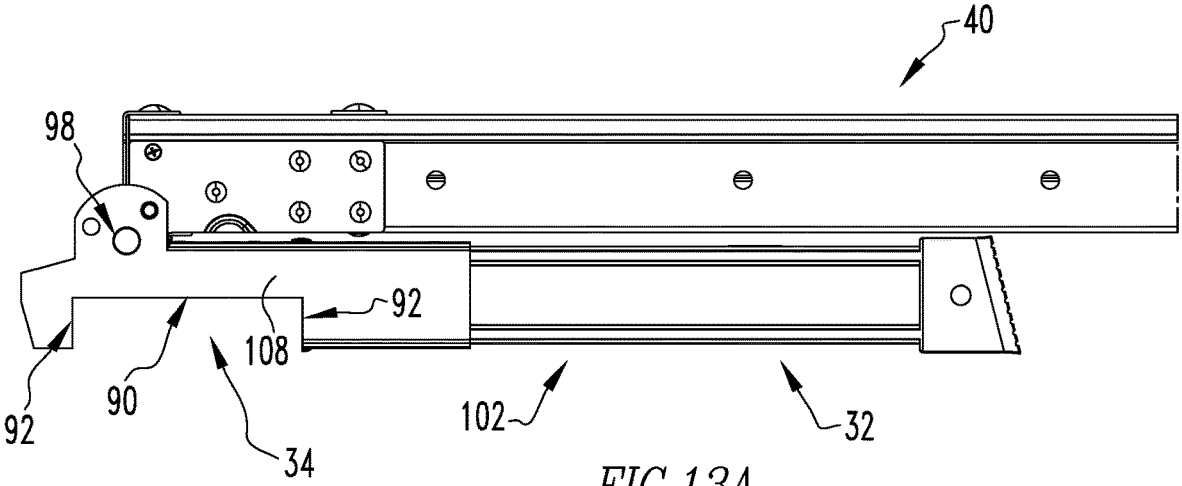
FIG. 13A is a side view of a leg with a recess in a closed position.
Figure 14A:
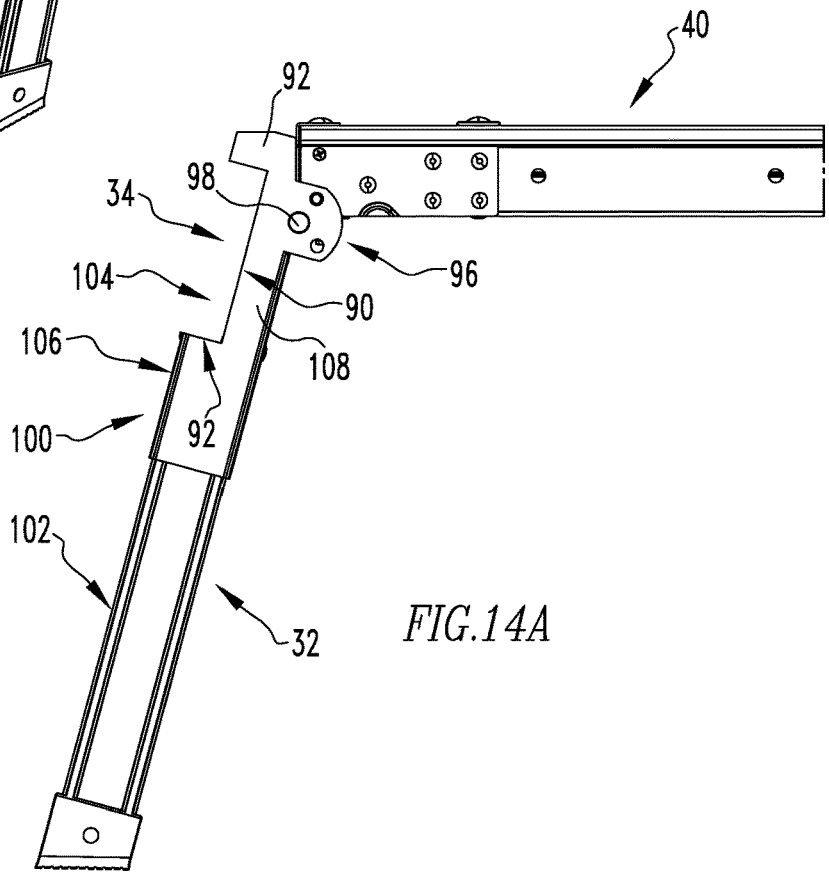
FIG. 14A is a side view of a leg with a recess in the open position.

A hinge portion 96 positioned opposite the recess adjacent the side portion 92 at the top of the leg, has a bolt 98 extending through it which rotatably attaches the leg to the plank 12 and serves as a pivot axis. The leg itself has an upper part 100 from about the top step of the respective leg assembly and has a width about half the width of the lower part 102 of the leg so the leg does not block the step 65 from receiving the recess. The recess itself with the hinge portion is part of a leg plate 104 which has a lower portion 106 that extends down from the lower side portion 92 and which conforms with the outer circumference of the flange and webs of the lower part 102 of the leg. The outer circumference of the flange and the webs of the leg plate 104 essentially form a C shape which matches the C shape of the outer circumference of the lower part 102 of the leg. The lower portion 106 is riveted to the lower part 102 of the leg adjacent where the top step is attached to the leg. A central portion 108 of the leg plate 104 which extends upwards from the lower portion 106 in between the recess and the hinge portion 96, is riveted to the upper part 100 of the leg. FIG. 13 shows a perspective view of the legs with recesses in the closed position. FIG. 13A is a side view of a leg with a recess in a closed position. FIG. 14 shows a perspective view of the legs with recesses in an open position. FIG. 14A is a side view of a leg with a recess in the open position.

A hook attachment technique, as shown if FIGS. 16-22, comprises at least a first hook 26 that rotates out of a first leg 32 of the first leg assembly 14 and is adjustable to grip the intended rung 65 or ladder jack. The first hook 26 can be rotated back in to a stowed position during work platform 10 mode, allowing the user to ascend or descend from the work platform 10 while utilizing the step features on the legs of the first or second leg assemblies and not be a tripping hazard. It is intended to secure the work platform 10 in plank 12 mode to a step ladder or ladder jack for device stability while the user is working on top of the work platform 10 in plank 12 mode. It is also used as a device that secures the work platform 10 in plank 12 mode to ladder jacks to prevent uplift due to wind.

A strap attachment technique, as shown in FIGS. 23-27, composes a strap assembly 122 having a strap 126 that wraps around the rung 65 of a step ladder or a ladder jack. It can be attached to either the legs or the plank 12 itself. The strap 126 can be tightened by a cinching system, ratcheting system, a hooking method, or a Velcro type of hook and loop fastener. FIGS. 29-32 show various buckles and straps that may be used. It is intended to secure the work platform 10 in plank 12 mode to a step ladder or ladder jack for device stability while the user is working on top of the work platform 10 in plank 12 mode. It also functions to secure the work platform 10 in plank 12 mode to step ladders or ladder jacks to prevent uplift due to wind.

Figure 28:
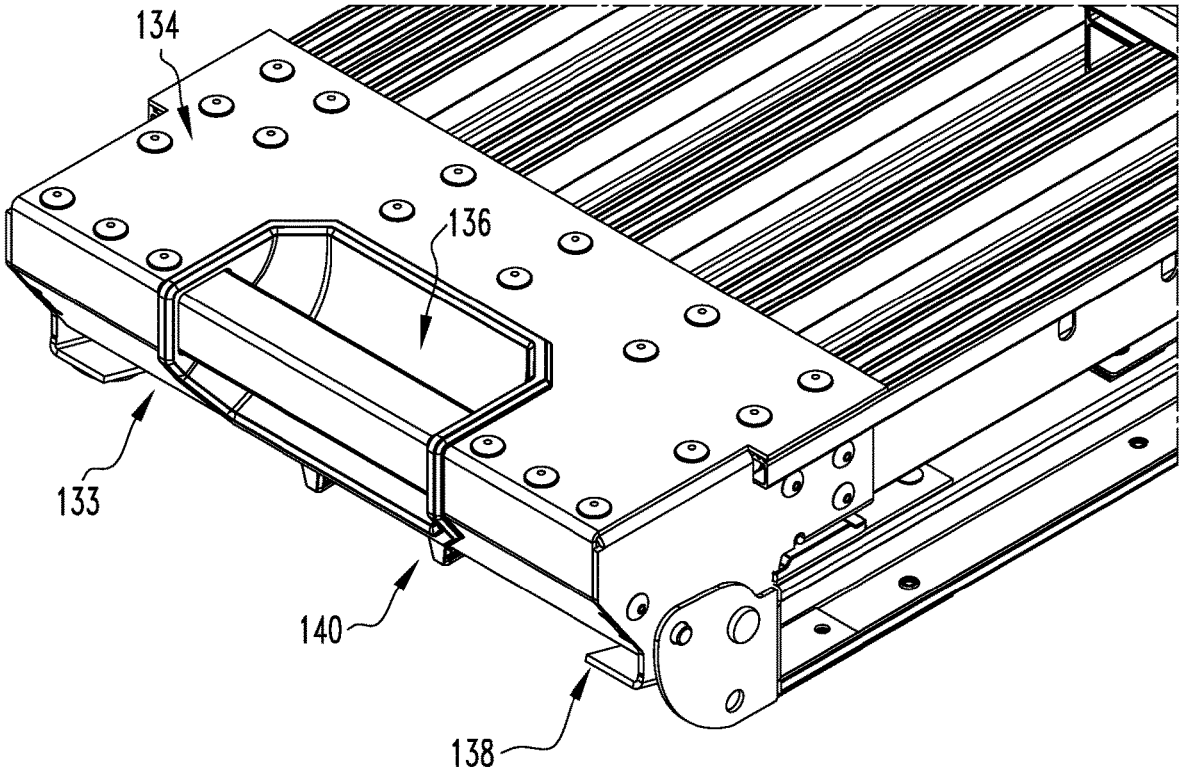
FIG. 28 shows the end handle design comprised of a space for the user to put their hand and grab onto an ergonomically designed handle bar.
Figure 29:
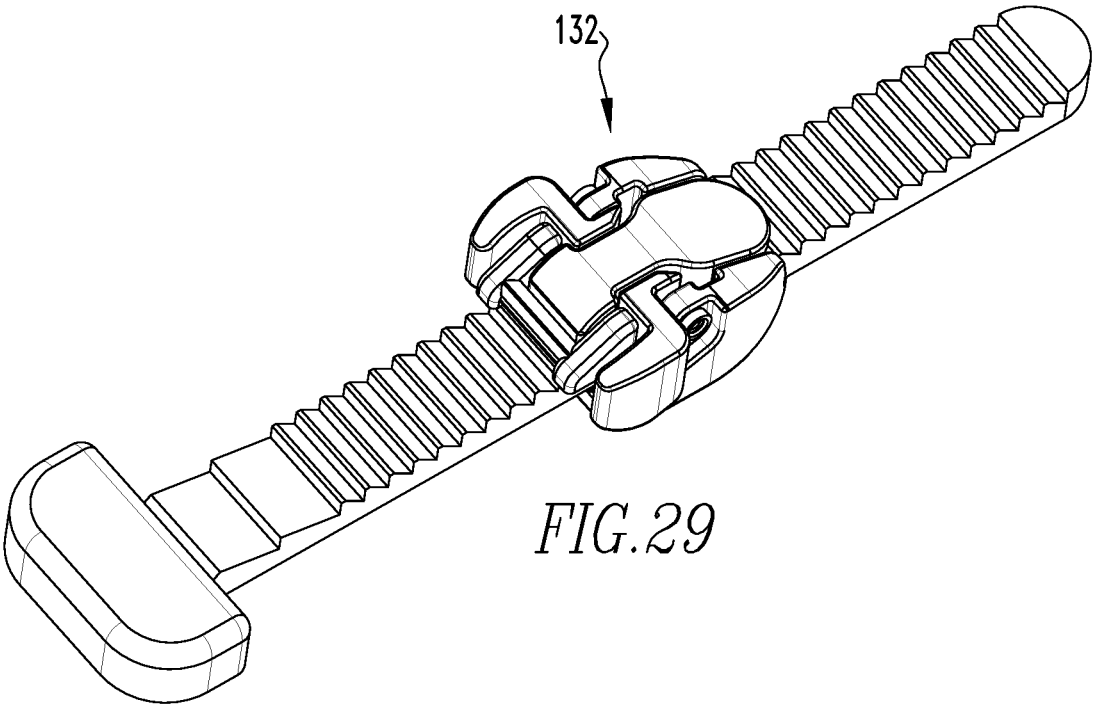
FIG. 29 shows a buckle for a strap
Figure 30:
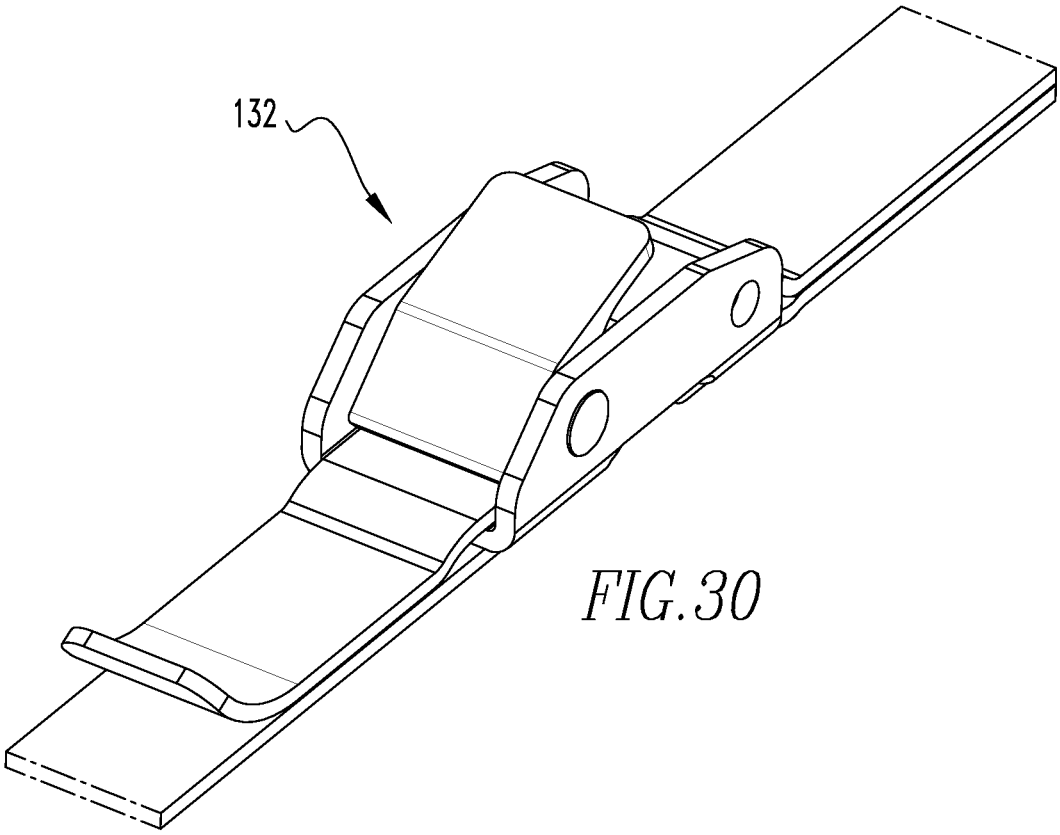
FIG. 30 shows a buckle for a strap.
Figure 31:
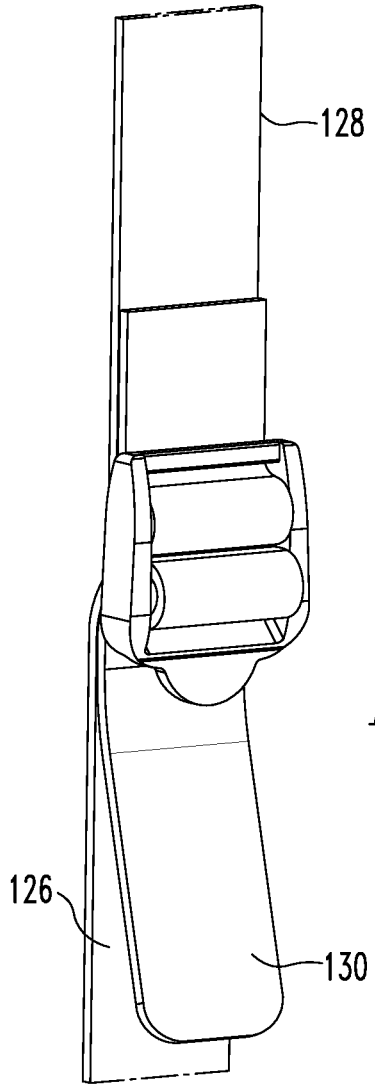
FIG. 31 shows a buckle for a strap.
Figure 32:
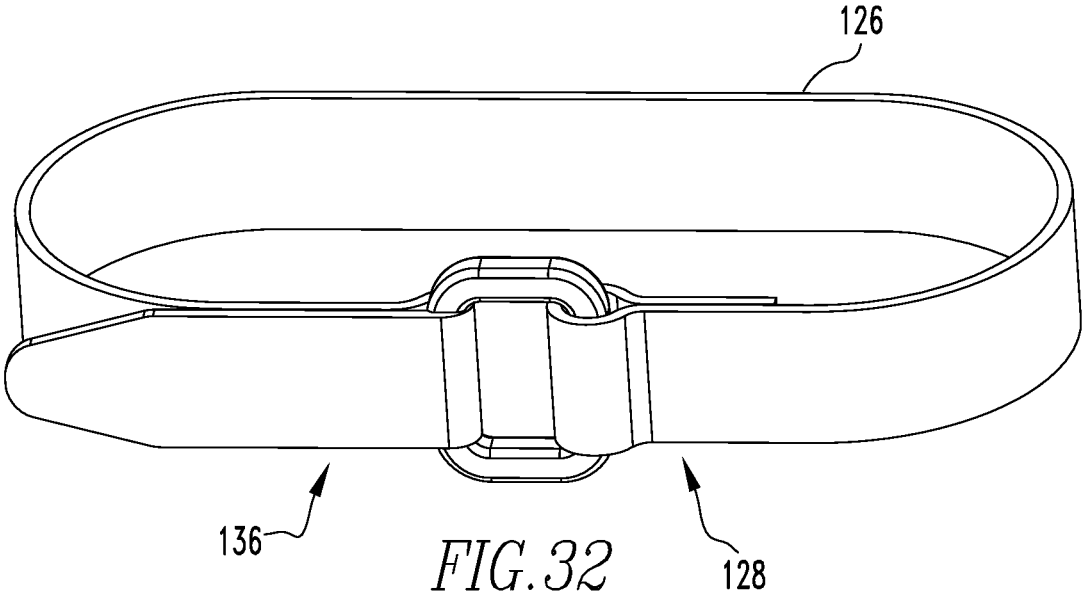
FIG. 32 shows a buckle for a strap.

An end handle 133, shown in FIG. 28, is conveniently located at both ends of the work platform 10. It can be used to carry the work platform 10. It can be used to help the user pull the work platform 10 from a truck bed. It can also be used to help the user adjust the telescoping length of the work platform 10.

The novelty of the strap and hook techniques is that the work platform 10 can be mechanically secured to a step ladder or ladder jack by unique built-in features. Typically, today if a user wants to secure a plank 12, he or she does so with his or her own equipment such as rope or bungee cords.

The novelty of the end handle 133 is that present adjustable planks do not have a handle which helps the user to adjust the length and is also used to carry the plank 12.

In regard to these additional embodiments, the hooks and straps provide very solid engagement with the plank 12 support surfaces.

Figure 16:
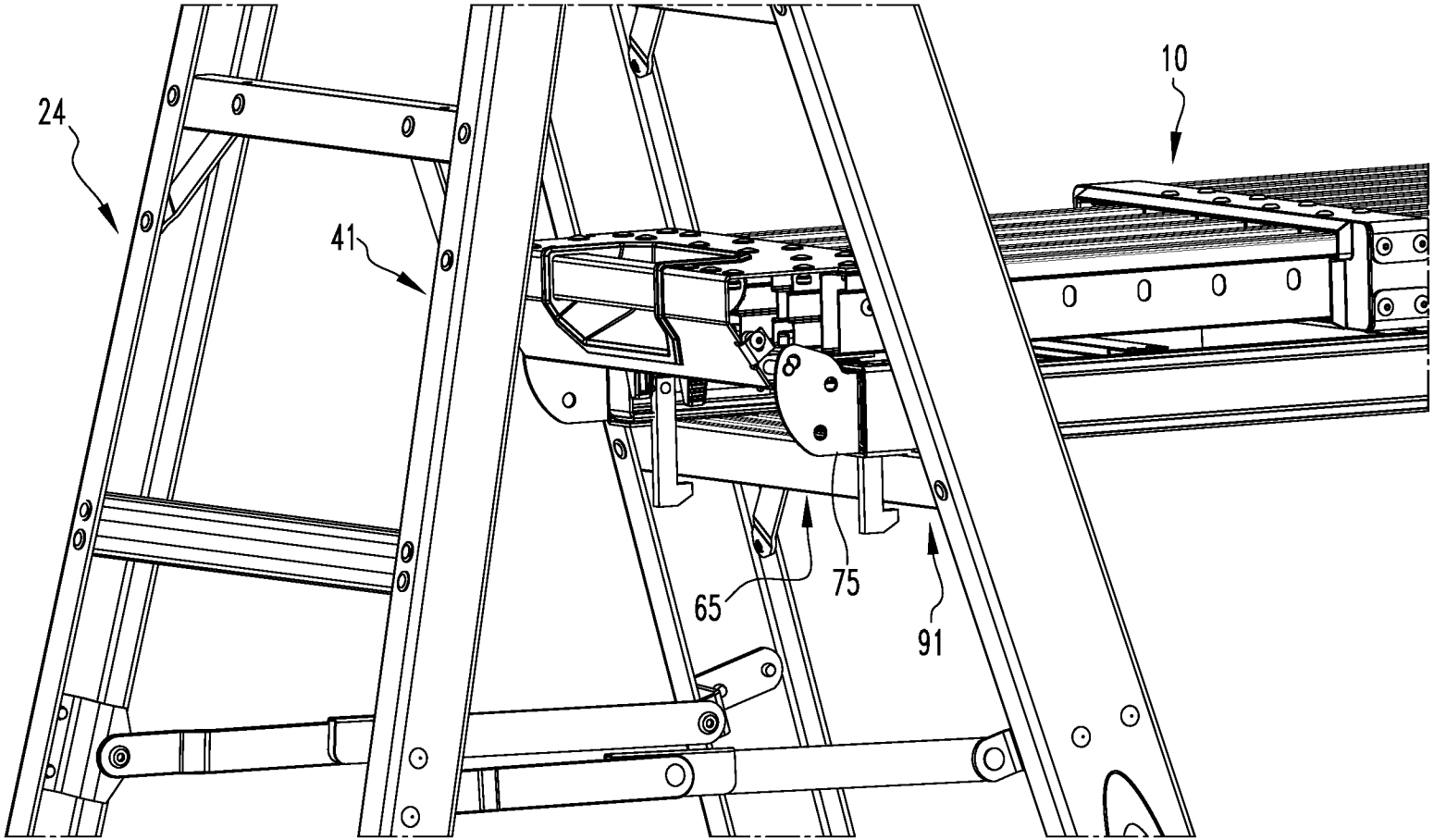
FIG. 16 shows the linkage attaching to a ladder rung via the hooks that extend from the legs of the platform while in plank mode.
Figure 17:
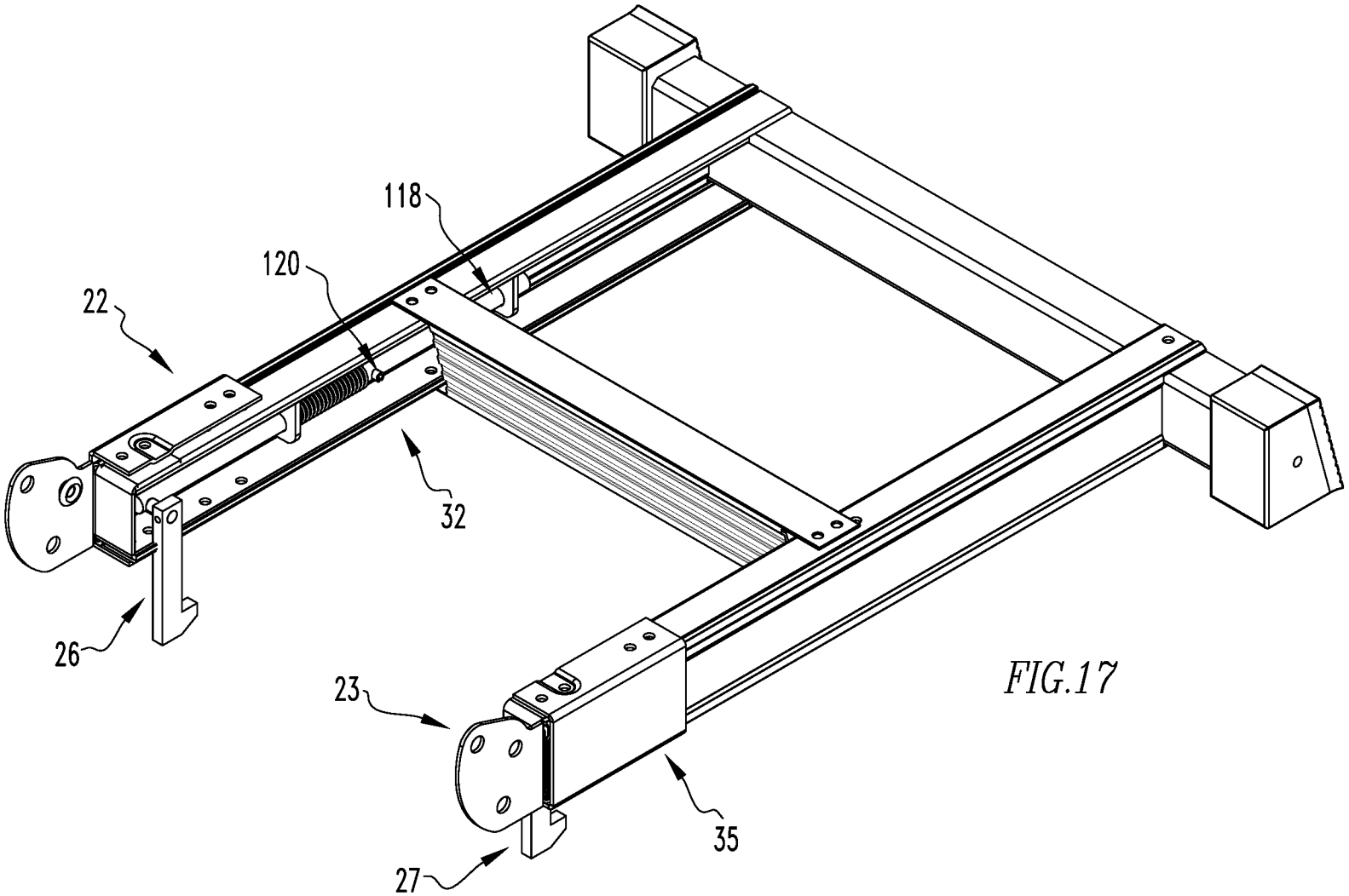
FIG. 17 shows the linkage fully deployed with the plank hidden.
Figure 18:
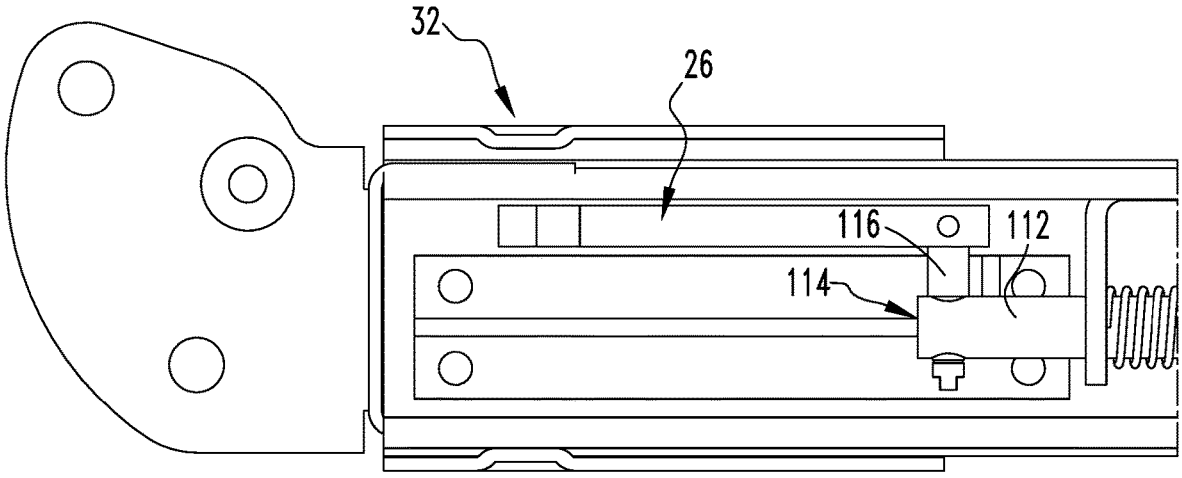
FIG. 18 shows the hook retracted into the rail when it is not in use.
Figure 19:
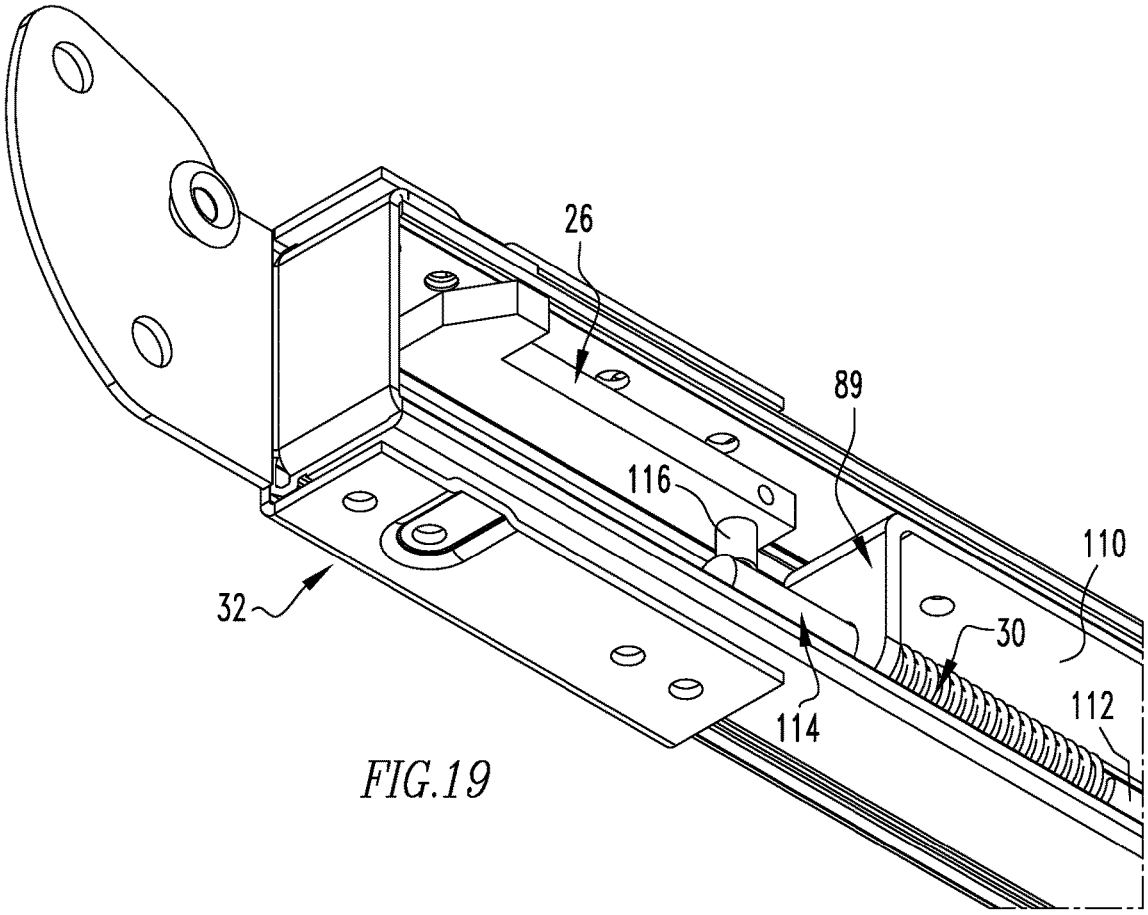
FIG. 19 shows the hook retracted into the leg when it is not in use.
Figure 20:
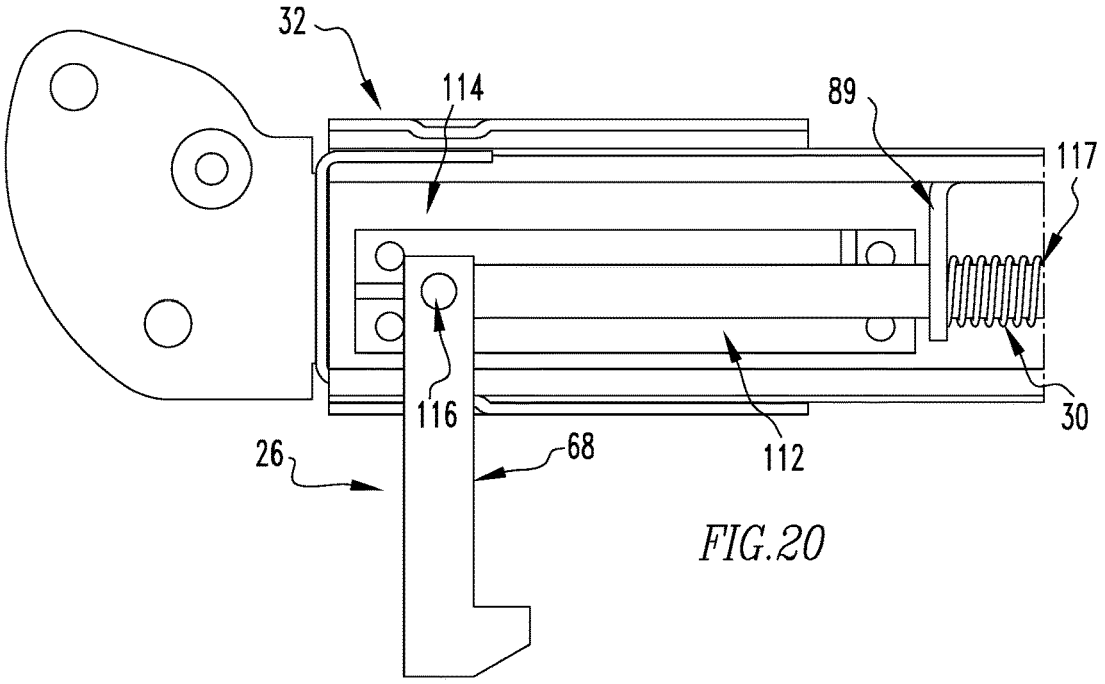
FIGS. 20, 21 and 22 show the sequence of the hook being moved into the stowed position.
Figure 21:
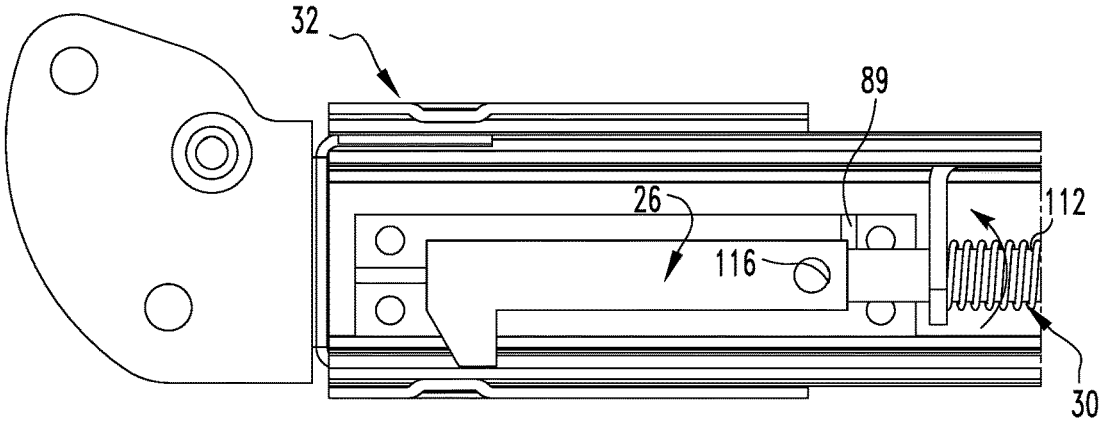
Figure 22:
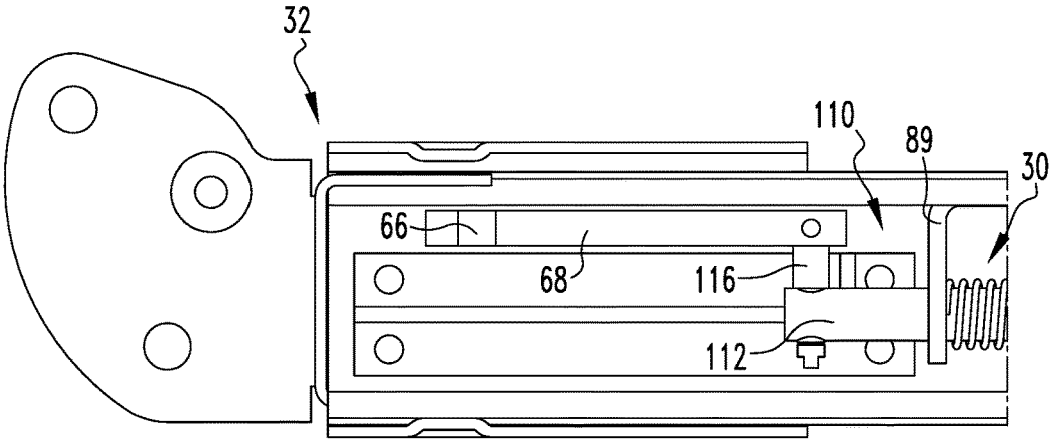

With reference to FIGS. 16-22, the first hook 26 may be mounted in a first leg 32 of the first leg assembly 14. The first hook 26 moves between a stowed position and a deployed position. The first hook 26 has an overhanging end 66 and a stem 68, as shown in FIG. 20. The stem 68 fits into the first leg 32 in the stowed position, as shown in FIGS. 18, 19 and 22. The platform 10 may include a spring 30 which biases the first hook 26 toward a closed position with the plank 12 when the first hook 26 is apart from the first support structure 24, and tensions the first hook 26 with the first support structure 24 to positively engage the first support structure 24 and facilitate a secure and tight fit of the first hook 26 with the first support structure 24. See FIGS. 19-22.

An outer end 62 of the spring 30 may be fixed to a first spring bracket 89 extending down from an inner surface 110 of the of the first leg 32. When the first hook 26 is pulled outward and the first hook 26 has been engaged with the first support structure 24, the first hook 26 is released which allows the first hook 26 to retract by the force of the spring 30 and positively engage the first support structure 24. The first linkage 22 may include a rod 112 which extends through and is in sliding engagement with the spring bracket 89. The rod 112 has a front end 114 disposed adjacent the first side 41 of the plank 12. The first hook 26 is engaged with the rod 112 adjacent the front end 114 of the rod 112. The first hook 26 is disposed perpendicular with the rod 112 in the deployed position and disposed parallel with the rod 112 in the stowed position. The spring 30 is disposed about the rod 112.

The overhanging end 66 may fit under and contact a bottom surface 91 of a rung 65 of the first support structure 24 and the stem 68 contacts an interior side 75 of the rung 65 to securely and stably hold the platform 10 to the first support structure 24, as shown in FIG. 16. The first linkage 22 may include a pin 116 that rotatably attaches the hook to the rod 112. The pin 116 extends through adjacent an end of the stem 68 opposite the overhanging end 66 and into the rod 112. An inner end 87 of the spring 30 may be attached to the rod 112. The rod 112 may rotate when the hook is parallel to the rod 112 to position the hook in the retracted position in the first leg. The platform may include a second spring bracket 89 extending down from the inner surface 110 of the of the first leg through which the rod 112 extends.

FIG. 16 shows the first hook 26 attaching to a ladder rung 65 via the first and second hooks that extend from the legs of the platform 10 while in plank 12 mode.

FIG. 17 shows the first hook 26 fully deployed with the plank 12 hidden.

FIG. 18 and FIG. 19 show the first hook 26 retracted into the first leg 32 when it is not in use.

FIGS. 20, 21 and 22 show the sequence of the first hook 26 being moved into the stowed position. The first hook 26 is attached to the horizontal rod 112 by a pin 116. This pin 116 connection allows the first hook 26 to be pivoted to a horizontal position, as seen in FIG. 21. Once it is horizontal, the first hook 26 and rod 112 together may be rotated about the long axis of the rod 112 to the stowed position in FIG. 22. Also seen in these figures is a coil spring surrounding the horizontal rod 112. This spring 30 urges the rod 112 and first hook 26 to move to the right as viewed in these figures. This spring 30 action causes the first hook 26 to firmly grip the ladder rungs, thus taking up any slack between the plank 12 and its supports and preventing the platform 10 from inadvertently coming off its supports due to wind gusts. The second linkage 23, including the second hook 27, operates the same way as the first linkage 22, including the first hook 26.

Alternatively, the first linkage 22 may include a first strap assembly 122 which extends from the first end 16 of the plank 12, as shown in FIGS. 23-27. The first strap assembly 122 may be connected to the first leg 32 of the first leg assembly 14. The strap assembly 122 may comprise abase 124 which is attached to the first leg and to a fixed end 128 of the strap 126. The strap assembly 122 may include a buckle 132 attached to the base 124 adjacent to the fixed end 128 of the strap 126. A free end 130 of the strap 126 may be disposed in and held by the buckle. The strap 126 it is adapted to be positioned about the rung 65 to hold the plank 12 securely to the first support structure 24.

Figure 23:
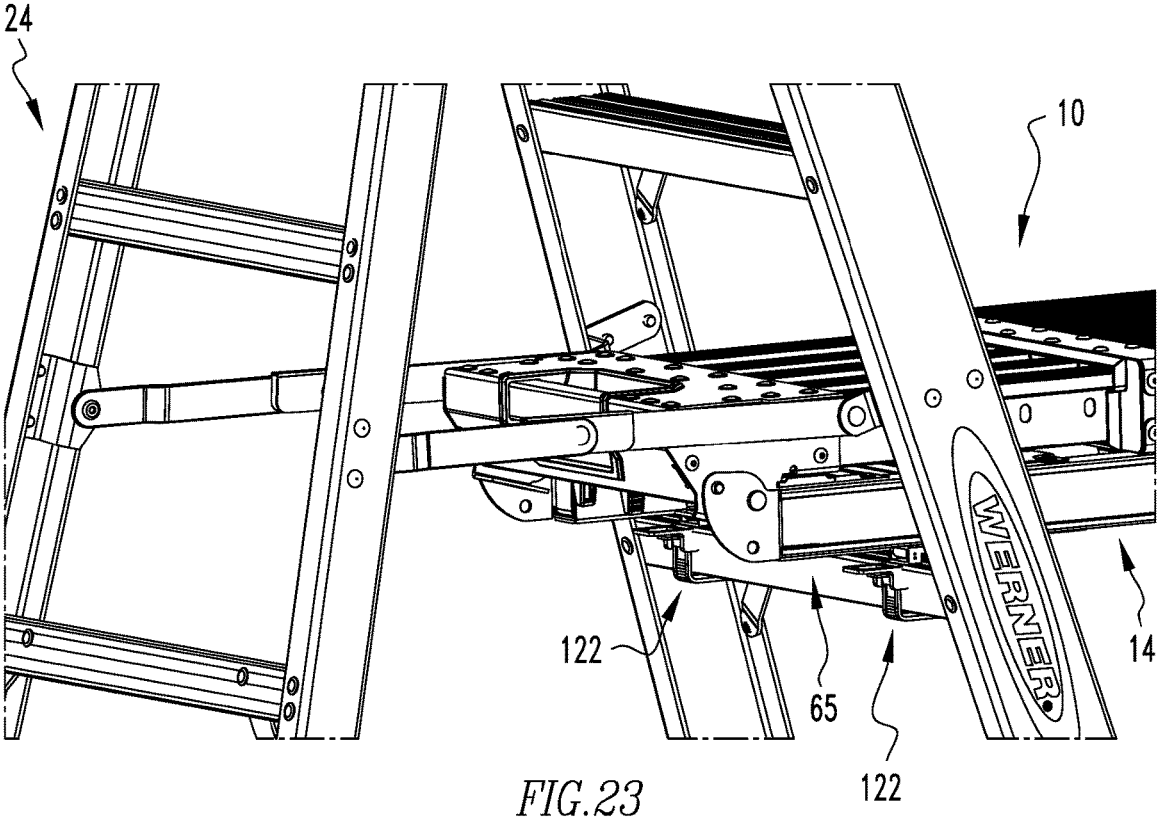
FIG. 23 shows straps attached to the platform which pass around a rung or ladder jack to prevent the platform from coming off its supports.
Figure 24:
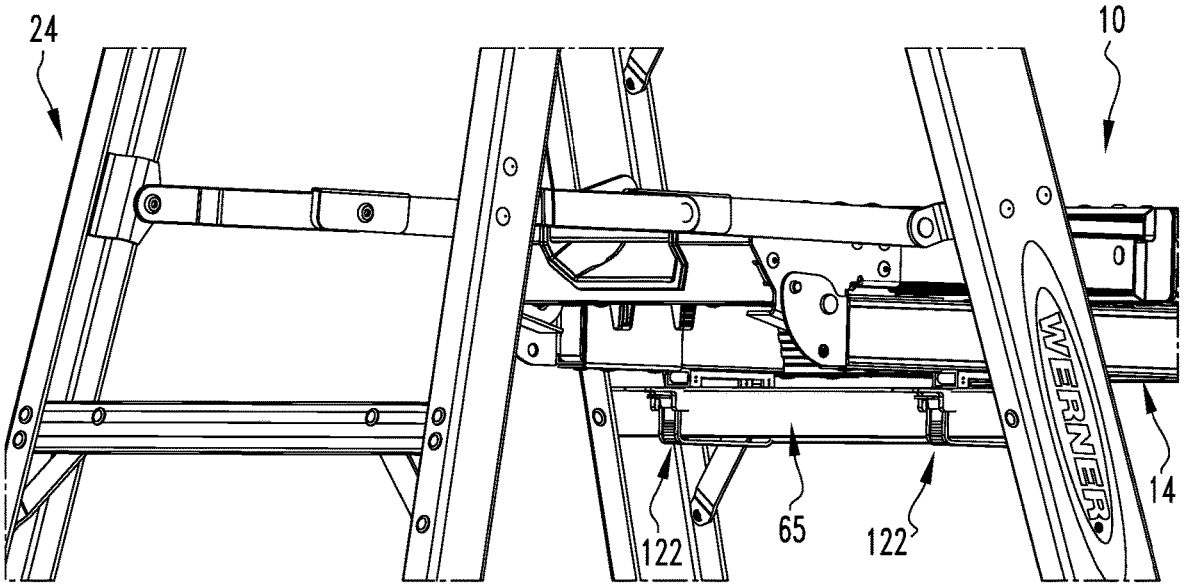
FIG. 24 shows straps attached to the platform which pass around a rung or ladder jack to prevent the platform from coming off its supports.
Figure 27:
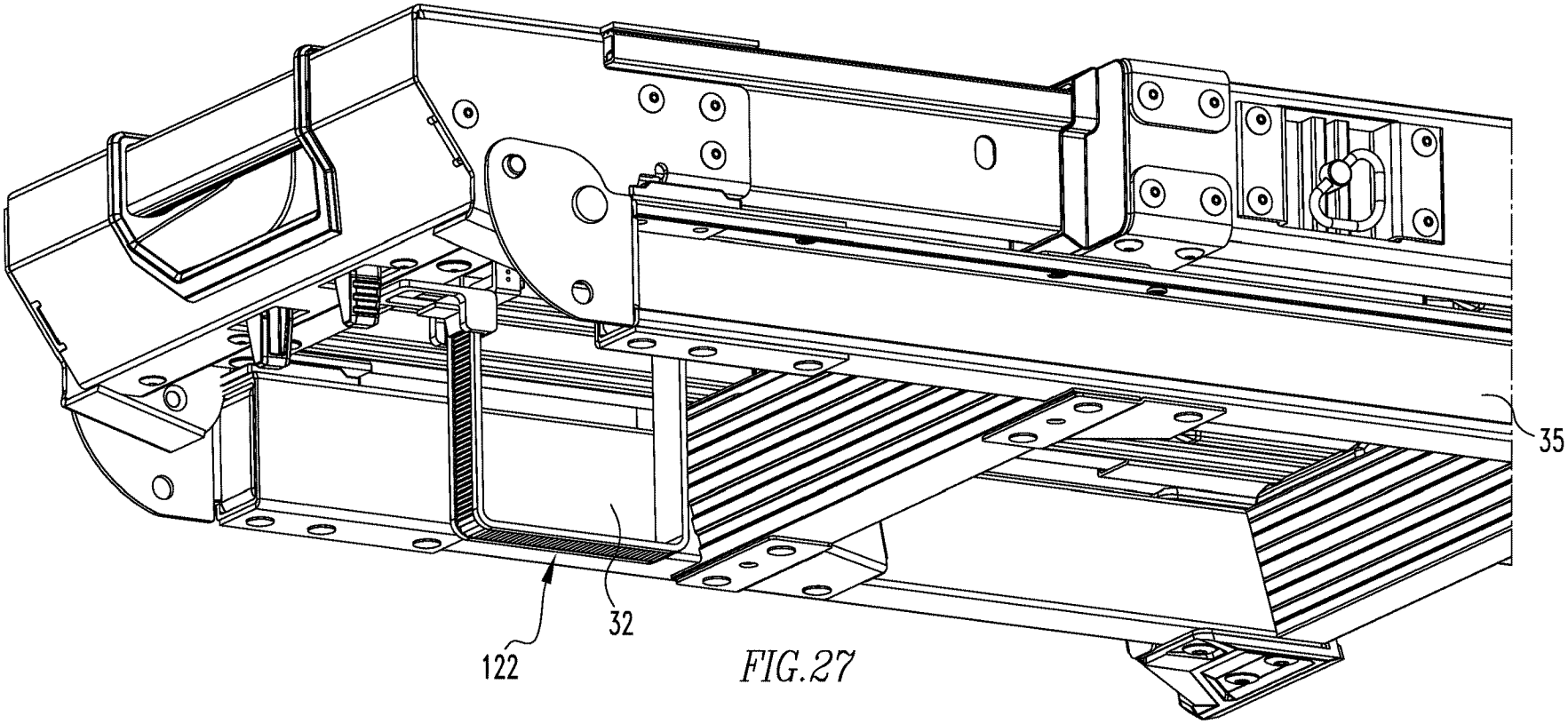
FIG. 27 shows the strap assembly on the plank surface.

FIGS. 23 and 24 show the strap concept comprising strap assemblies 122 attached to the platform 10 which pass around a rung 65 or ladder jack to prevent the platform 10 from coming off its support structures. In FIGS. 23 and 24, a strap assembly 122 is connected to each of the legs of the first leg assembly 14 of the platform 10. As shown in FIG. 27, the strap assembly 122 comprises a base 124 with a strap 126 which can be flat web fabric or flat reinforced rubber material. The fixed end 128 of the strap 126 is connected to the base 124. After passing around the step or ladder jack the free end 130 of the strap 126 is fed into and is held by a friction buckle 132 such as used on rifle slings, or a ratchet mechanism such as used on cargo tie down systems. See FIGS. 29-32 of typical buckles and fastening systems. This arrangement enables the strap 126 to be cinched tight.

Figure 25:
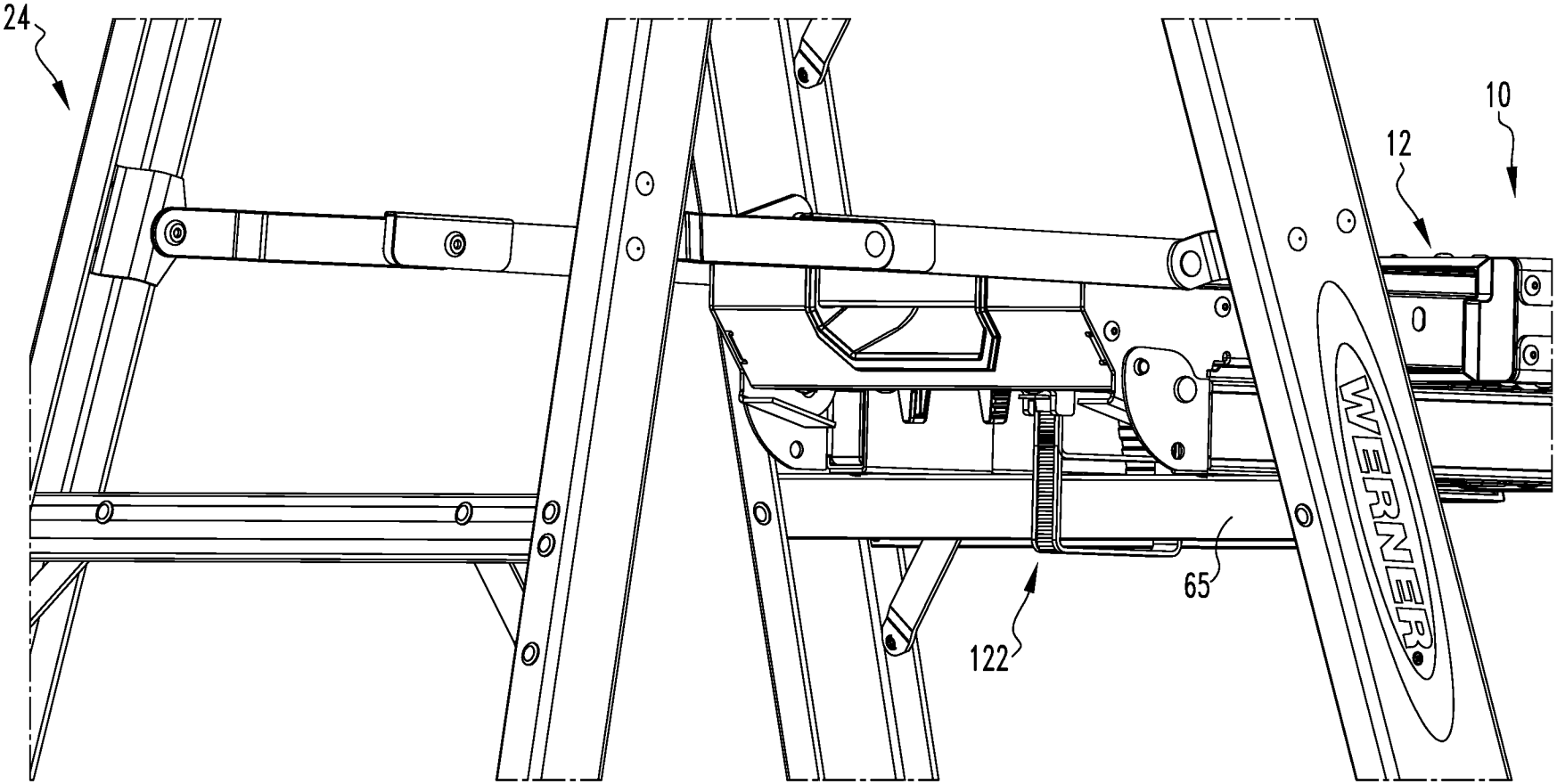
FIG. 25 shows a single strap in which the strap assembly is attached directly to the plank portion of the platform instead of to the legs.

FIG. 25 shows a single strap 126 in which the strap assembly 122 is attached directly to the plank 12 portion of the platform 10 instead of to the legs. The method of tightening the strap 126 is the same. The purpose is also the same with the intention of securing the platform 10 to a ladder rung or ladder jack.

Figure 26:
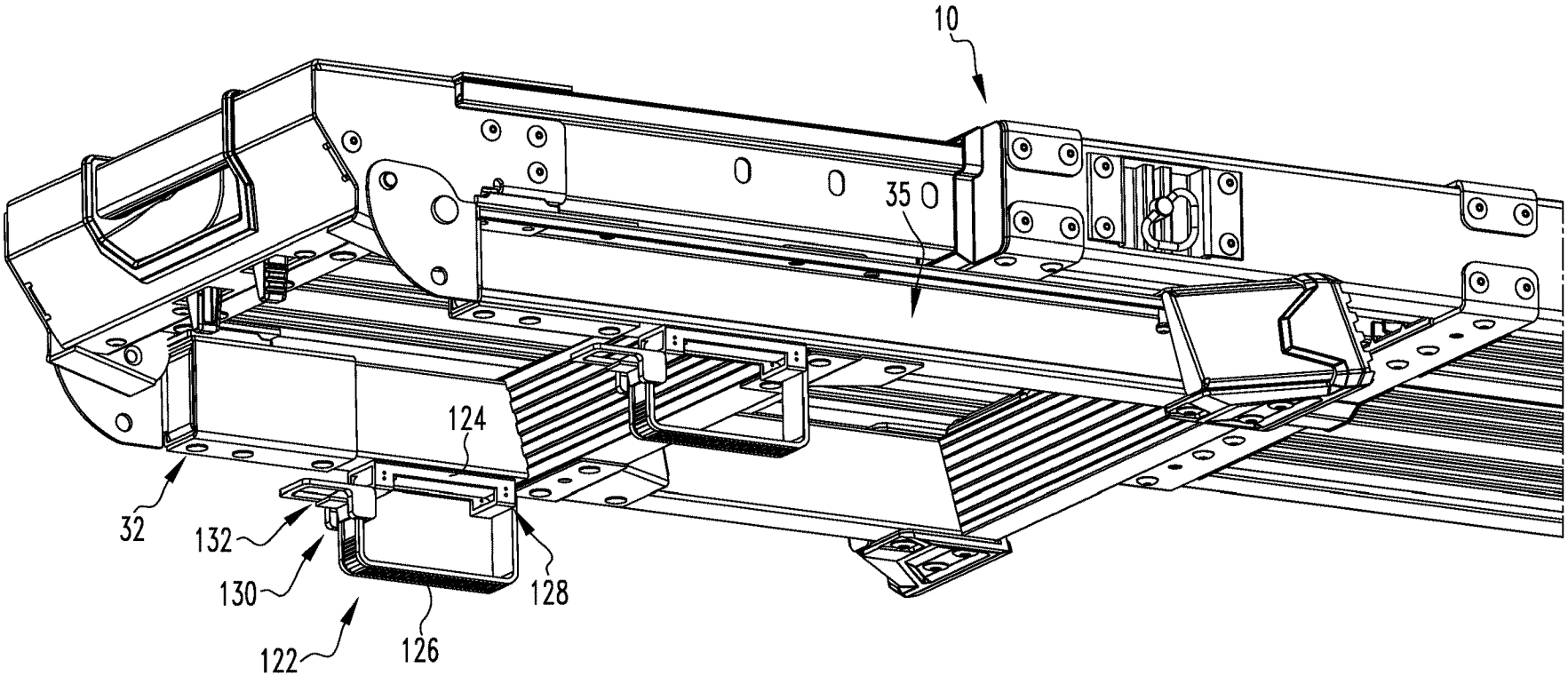
FIG. 26 shows the strap assemblies on the legs.

FIGS. 26 and 27 are more views showing the strap assemblies 122 on the legs and on the plank 12 surface as optional attachment locations.

FIG. 28 shows the end handle 133 design comprising a handle recess 136 for the user to put their hand in and grab onto the ergonomically designed end handle 133. This helps the user to carry the platform 10 and also helps the user to adjust the length of the platform 10. The end handle 133 fits into and aligns with the first end 16 and aligns with the top surface of the plank 12 so the end handle 133 defines a first flat plane with the first end 16 and a second flat plane with the top surface of the plank 12. This way, the end handle 133 does not have portions which extend out and possibly cause the user to trip or catch on the end handle 133. There is a recess 136 in the plank 12 adjacent the first end 16 aligned with the end handle 133 for the fingers of a hand to fit in to wrap around the end handle 133. The recess 136 is about the same length as the length of the end handle 133. Preferably, in this embodiment there is a handle bracket 134 which fits onto and is attached to the top surface of the first supports 54 adjacent to the first end 16. The end handle 133 is disposed, as described above, in the handle bracket 134 and is centered in the handle bracket 134, and has a length of about ⅓ the length of the handle bracket 134. The handle recess 136 is disposed in the handle bracket 134, as described above. The end handle 133 may have a square or rectangular cross-section. The handle bracket 134 may have tab stops 120 extending down from the handle bracket 134 to stop the first leg assembly 14 from extending open to far. The tab stops 120 also press against the first leg assembly 14 to tension the platform 10 in the open position/work platform 10 mode. There may be a pinch lock 50 under the plank 12 and attached to the plank 12 to lock the first leg assembly 14 in the open position/work platform 10 mode or the closed position/plank 12 mode. The same description is applicable regarding a second end handle in regard to the second end 20.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A work platform comprising:

a plank which telescopes to a desired width;

a first leg assembly rotatably attached adjacent to a first end of the plank;

a second leg assembly rotatably attached adjacent to a second end of the plank, wherein the work platform is in an open position when the plank is supported by the first leg assembly and second leg assembly and wherein in the open position the first leg assembly and second leg assembly form an angle greater than 25 degrees with the plank, and wherein the work platform is in a closed position when the first leg assembly and second leg assembly are adjacent to and in parallel with the plank; and a first linkage which extends adjacent the first end of the plank and adapted to engage a first support structure to securely hold the plank to the first support structure, wherein the first linkage includes a first strap assembly that includes a first strap positioned to wrap around the first support structure.

2. The work platform of claim 1 wherein the first strap assembly comprises a base which is attached to the first leg assembly and to a fixed end of the first strap.

3. The work platform of claim 2 wherein the first strap assembly includes a buckle attached to the base to engage a free end of the first strap.

4. The work platform of claim 1 wherein the first strap assembly is attached to the first leg assembly.

5. The work platform of claim 1 wherein the first strap assembly is attached to an underside of the plank.

6. The work platform of claim 1 further comprising a second linkage which extends adjacent the first end of the plank, the second linkage including a second strap assembly that includes a second strap positioned to wrap around the first support structure.

7. The work platform of claim 1 wherein the first strap is formed of a fabric or rubber material.

8. The work platform of claim 1 wherein the plank includes a first handle disposed in the first end.

9. The work platform of claim 1 wherein the plank includes a deck, a first extension portion which extends and retracts from a first side of the deck, the first leg assembly being rotatably attached adjacent to an outer end of the first extension portion, and a second extension portion which extends and retracts from a second side of the deck, the second leg assembly being rotatably attached adjacent to an outer end of the second extension portion.

* * * * *